US005781061A

United States Patent [19]

Miyashita et al.

[11] Patent Number: 5,781,061

[45] Date of Patent: Jul. 14, 1998

[54] CURRENT MIRROR CIRCUIT AND SIGNAL PROCESSING CIRCUIT HAVING IMPROVED RESISTANCE TO CURRENT OUTPUT TERMINAL VOLTAGE VARIATION

[75] Inventors: Miyo Miyashita; Kazuya Yamamoto, both of Tokyo, Japan

[73] Assignee: Mitsubishi Denki Kabushiki Kaisha, Tokyo, Japan

[21] Appl. No.: 696,093

[22] Filed: Aug. 13, 1996

[30] Foreign Application Priority Data

Feb. 26, 1996 [JP] Japan ..... 8-037623

[51] Int. Cl.[6] ..... G05F 3/02

[52] U.S. Cl. ..... 327/543; 327/362; 327/538; 323/315; 323/317; 330/288

[58] Field of Search ..... 327/66, 310, 541, 327/543, 362, 538, 540; 323/315, 316, 317; 330/257, 288

[56] References Cited

U.S. PATENT DOCUMENTS

| | | | |
|---|---|---|---|
| 3,813,583 | 5/1974 | Akiyama | 327/581 |
| 4,401,897 | 8/1983 | Martino, Jr. et al. | 327/541 |
| 4,639,617 | 1/1987 | Giakounis | 327/541 |
| 5,072,143 | 12/1991 | Gantioler et al. | 327/451 |
| 5,087,891 | 2/1992 | Cytera | 330/288 |
| 5,157,322 | 10/1992 | Llewellyn | 330/257 |
| 5,166,553 | 11/1992 | Kotera et al. | 326/115 |
| 5,220,289 | 6/1993 | Kunitaka | 330/257 |
| 5,227,714 | 7/1993 | Lou | 323/315 |
| 5,446,397 | 8/1995 | Yotsuyanagi | 327/66 |
| 5,483,194 | 1/1996 | Genest | 330/257 |

FOREIGN PATENT DOCUMENTS

| | | | |
|---|---|---|---|
| 57-60711 | 4/1982 | Japan | 330/257 |
| 77204 | 1/1995 | Japan . | |

OTHER PUBLICATIONS

Miyashita et al., "A GaAs LD Driver IC For A 2.5 Gb/s Optical Communication System", 24th European Microwave Conference, vol. 2, Sep. 1994, pp. 1649–1654.

*Primary Examiner*—Kenneth B. Wells
*Attorney, Agent, or Firm*—Leydig, Voit & Mayer, Ltd.

[57] ABSTRACT

A current mirror circuit includes a current input terminal; a first FET and a second FET, each having a gate terminal, a drain terminal, and a source terminal, the gate terminal of the first FET being connected to the gate terminal of the second FET; a third FET having a source terminal connected to the drain terminal of the first FET, and a drain terminal and a gate terminal connected to each other and to the current input terminal; and a fourth FET having a source terminal connected to the drain terminal of the second FET, a gate terminal connected to the gate terminal of the third FET, and a drain terminal serving as a current output terminal. Therefore, even when the output voltage varies, since the current is almost constant, the circuit is not adversely affected by the variation in the output voltage. As a result, error in the output current in response to variations in the output voltage is significantly reduced.

7 Claims, 16 Drawing Sheets

CURRENT MIRROR CIRCUIT AND SIGNAL PROCESSING CIRCUIT HAVING IMPROVED RESISTANCE TO CURRENT OUTPUT TERMINAL VOLTAGE VARIATION

FIELD OF THE INVENTION

The present invention relates to a semiconductor circuit including field effect transistors (hereinafter referred to as FETs) and, more particularly, to a current mirror circuit having electrical characteristics independent of drain conductances of the FETs. The present invention also relates to a signal processing circuit employing the current mirror circuit.

BACKGROUND OF THE INVENTION

FIG. 14 is a diagram illustrating a prior art current mirror circuit. The current mirror circuit includes an input terminal 1 through which a current $I_1$ flows, an output terminal 2 receiving a current $I_2$ proportional to the current $I_1$, a power supply terminal 5 to which a positive power supply voltage $V_{DD}$ is applied, a power supply terminal 6 to which a negative power supply voltage is applied, and a current source 10 supplying the current $I_1$. The power supply terminal 6 is connected to the ground GND. Further, the current mirror circuit includes enhancement type MESFETs A11, A12, and A13, a level shift circuit LS, and a resistor Z1. The MESFETs A11, A12, and A13 are formed in a GaAs integrated circuit (hereinafter referred to as GaAs IC) or the like and have the same gate length and the same threshold voltage $V_{th}$. The level shift circuit LS comprises a single diode or a plurality of diodes connected in series. For example, when the forward bias voltage of the diode is 0.6 V, the level shift circuit comprises one diode or two diodes. The resistor Z1 is set at a value in a range from 200Ω to 1 kΩ when a current of 1 mA flows through the resistor Z1.

In the prior art current mirror circuit shown in FIG. 14, a drain terminal of the FET A11 is connected to the input terminal 1, and a source terminal thereof is connected to the negative power supply terminal 6. An end (first end) of the resistor Z1 is connected to a gate terminal of the FET A11, and the other end thereof (second end) is connected to the power supply terminal 6. A drain terminal of the FET A13 is connected to the positive power supply terminal 5, and a gate terminal thereof is connected to the drain terminal of the FET A11. A high potential end of the level shift circuit LS is connected to a source terminal of the FET A13, and a low potential end thereof is connected to a node between the first end of the resistor Z1 and the gate terminals of the FETs A11 and A12. Further, a drain terminal of the FET A12 is connected to the output terminal 2, a gate terminal thereof is connected to the gate terminal of the FET A11 and to a node between the low potential end of the level shift circuit LS and the first end of the resistor Z1, and a source electrode thereof is connected to the power supply terminal 6. Furthermore, the power supply terminal 5 is connected to a power source generating the power supply voltage $V_{DD}$, and the power supply terminal 6 is connected to the ground GND. The current supply 10 is connected between the power supply terminal 5 and the input terminal 1.

A description is given of the operation. Since the input impedance of the MESFET viewed from the gate is large, the current $I_1$ from the current source 10 does not flow into the gate of the FET A13 but flows into the drain terminal of the FET A11. Since the FET A11 is an enhancement type MESFET ($V_{th}>0$) and the drain-source current $I_{ds}$ is equal to the current $I_1$ (>0), the gate-source voltage $V_{gs}$ is larger than 0, so that a current flows through the resistor Z1 connected between the gate and the source of the FET A11 and, simultaneously, a current flows through the level shift circuit LS.

Since the level shift circuit LS comprises a single diode or a plurality of diodes connected in series, when a forward current flows through the level shift circuit LS, a constant forward voltage is generated, whereby the source potential of the FET A13 increases. Further, when a current flows through the level shift circuit LS and a drain current flows through the FET A13 connected to the level shift circuit LS, since the gate-source voltage of the FET A13 is positive, the gate potential of the FET A13, i.e., the drain voltage of the FET A11, increases. At this time, in order to make the FET A11 operate in the saturation region, the level shift quantity of the level shift circuit LS is adjusted in advance by, for example, connecting a plurality of diodes in series. Thereby, the drain-source current $I_{ds}$ of the FET A11 in the saturation region ($0<V_{gs}-V_{th}\geqq V_{ds}$), i.e., the input current $I_1$, is given by $$I_1=K_0\cdot(1+\lambda V_{(1)})\cdot(V_{gsA11}-V_{th})^2 \tag{1}$$

where $V_{(1)}$ is the drain-source voltage of the FET A11 ($=V_{dsA11}$), $V_{gsA11}$ is the gate-source voltage of the FET, $K_0$ is the gain parameter of the FET, and λ is the channel length modulation parameter of the FET. When the gate length of the FET A11 is equal to the gate length of the FET A13, $K_0$ is proportional to the gate width of the FET A11, and λ is constant.

On the other hand, the drain terminal of the FET A12 is connected to the output terminal 2, the source terminal thereof is connected to the power supply terminal 6, and the gate terminal thereof is connected to a node between the FET A11 and the resistor Z1. When the ratio of the gate width of the FET A11 to the gate width of the FET A12 is 1:m (m>0) and a voltage that makes the FET A12 operate in the saturation region is applied to the output terminal 2, the drain current of the FET A12, i.e., the output current $I_2$, is given by $$\begin{aligned} I_2 &= m\cdot K_0\cdot(1+\lambda V_{(2)})\cdot(V_{gsA12}-V_{th})^2 \\ &= m\cdot K_0\cdot(1+\lambda V_{(2)})\cdot(V_{gsA11}-V_{th})^2 \\ &= m\cdot I_1\cdot(1+\lambda V_{(2)})/(1+\lambda V_{(1)}) \end{aligned} \tag{2}$$

where $V_{(2)}$ is the drain-source voltage of the FET A12 ($=V_{dsA12}$), and $V_{gsA12}$ is the gate-source voltage of the FET.

In equation (2), when the drain conductance $G_d$ ($=\Delta I_{ds}/\Delta V_{ds}$) of the FET can be ignored, i.e., when λ is equal to zero, the current $I_2$ flowing through the output terminal 2 is given by $$I_2=m\cdot I_1 \tag{3}$$

and a current corresponding to the ratio of the size of the FET A11 to the size of the FET A12 flows.

FIG. 16 is a diagram illustrating a prior art current driver circuit using a current mirror circuit identical to the current mirror circuit shown in FIG. 14 as a constant current source and including a differential amplifier that has two inputs and produces an output signal that is a function of the difference between the inputs. In the figure, FETs A1 and A2 are a differential pair of transistors, source terminals of which are connected to each other. In addition, these FETs A1 and A2 form an open drain circuit 40, i.e., drain terminals thereof are connected to output terminals OUT and $\overline{\text{OUT}}$ of the current driver circuit, respectively. Further, a load resistor Z2 is connected between the output terminal OUT and the ground GND, and a load resistor Z3 is connected between the output terminal $\overline{OUT}$ and the ground GND. An input buffer 7 comprises a differential amplifier (not shown) and a level shift circuit (not shown) and amplifies a pair of input signals to amplitudes required for inputs of the open drain circuit 40, i.e., gate inputs of the FETs A1 and A2. A current driver circuit 20 comprises the input buffer 7 and the open drain circuit 40. A constant current source 30 comprises a current mirror circuit identical to the current mirror circuit shown in FIG. 14, and the voltage at an output terminal 2 of the current mirror circuit is equal to a difference between the output level of the output OUT ($\overline{OUT}$) from the input buffer 7 and the gate-source voltage of the FET A1 (FET A2). Furthermore, the current driver circuit includes a power supply terminal 5 connected to the ground GND and a power supply terminal 6 connected to a negative terminal of a power supply $V_{SS}$. A positive terminal of the power supply $V_{SS}$ is connected to the ground GND.

A description is given of the operation. When a current $I_1$ from the current source 10 is applied to the input terminal 1, a current $I_2$ proportional to the current $I_1$ flows through the source terminals of the FETs A1 and A2 constituting the open drain circuit 40. The positive phase input terminal IN of the input buffer 7 is connected to a signal source Sig, and the opposite phase input terminal $\overline{IN}$ of the input buffer 7 is connected to a negative terminal of a reference voltage supply $V_{REF}$. An input signal from the signal source Sig is amplified in the input buffer 7, whereby the FET A1 and the FET A2 alternatingly turn ON and OFF in response to the level of the signal voltage from the signal source Sig and the level of the reference voltage from the reference voltage supply $V_{REF}$. By the alternating ON and OFF switching of the FETs A1 and A2, the current path of the current $I_2$ is changed, and a modulation current having an amplitude equivalent to that of the current $I_2$ is output from the output terminals OUT and $\overline{OUT}$.

In the prior art current mirror circuit shown in FIG. 14, however, substantial drain conductances of the MESFETs are large and adversely affect the circuit characteristics. FIGS. 15(*a*) and 15(*b*) show output current characteristics of the prior art current mirror circuit. More specifically, FIG. 15(*a*) shows variations in the output current $I_2$ when the input current $I_1$ is constant and the voltage at the output terminal $V_2$ varies. In FIG. 15(*a*), the ratio of the gate width of the FET A11 to the gate width of the FET A12 is 1:1. FIG. 15(*b*) shows the relationship between the voltage at the input terminal 1 and the voltage at the output terminal 2.

In the circuit structure shown in FIG. 14, since a constant gate voltage is given to the FET A12, the $I_2$–$V_2$ characteristics are identical to the $I_{ds}$–$V_{ds}$ characteristics of the single FET A12 itself. Only when $V_1$ is equal to $V_2$ ($V_{2b}$ in the figure), $I_1$ is equal to $I_2$, i.e., the current ratio is equal to the gate width ratio.

As described above, in the prior art current mirror circuit, since only the gate-source voltage of the FET A12 through which the input current $I_1$ flows is certain for the input current $I_1$, the voltage at the output terminal 2 varies in an element having a high drain conductance, resulting in an error in the output current $I_2$.

Furthermore, in the prior art current driver circuit including the current mirror circuit as a constant current source, since the output terminal voltage $V_{(2)}$ of the current mirror circuit depends on the output voltage from the input buffer 7, the output terminal voltage $V_{(2)}$ is not always equal to the input terminal voltage $V_{(1)}$, so that the modulation current $I_2$ has an error with respect to the constant reference current $I_1$.

FIGS. 17(*a*)–17(*c*) are diagrams for explaining drawbacks in the prior art current driver circuit. In the current driver circuit, the input signal Sig is an sine wave of 10 GHz. The gate width of the FET A11 is 200 μm, and the gate width of the FET A12 is 600 μm. FIG. 17(*a*) shows the node voltages in the current mirror circuit, wherein the solid line and the dashed line show the signals input to the current mirror circuit from the input buffer 7, the alternating long and short dash line shows the output terminal voltage $V_{(2)}$, i.e., the drain voltage of the FET A12, and the dotted line shows the input terminal voltage $V_{(1)}$, i.e., the drain voltage of the FET A11. As shown in FIG. 17(*a*), the difference between the drain voltage $V_{(1)}$ of the FET A11 and the drain voltage $V_{(2)}$ of the FET A12 is about 1.5 V. FIG. 17(*b*) shows the input current $I_1$ and the output current $I_2$ of the current mirror circuit, wherein the solid line shows the input current $I_1$ (=5 mA) and the dashed line shows the output current $I_2$. FIG. 17(*c*) shows waveforms of the output currents from the output terminals OUT and $\overline{OUT}$ of the current driver circuit. Since the ratio of the size of the FET A11 to the size of the FET A12 is 1:3, an ideal value for the output current $I_2$ is 15 mA (=5 mA×3). However, since the drain voltage $V_{(2)}$ of the FET A12 is 1.5 V higher than the drain voltage $V_{(1)}$ of the FET A11, the output current $I_2$ in the current mirror circuit is about 20 mA. Because of the increase in the current from the constant current source, the output current amplitude becomes 22 mA, resulting in an error of 50% from the set value (=15 mA).

Further, when the power supply voltage $V_{SS}$ varies, the drain-source voltage of the FET A12 that divides the power supply voltage $V_{SS}$ by resistances varies, whereby the change of the voltage at the output terminal 2 of the current mirror circuit becomes different from the change of the power supply voltage $V_{SS}$. As the result, the output current $I_2$ varies though the input current $I_1$ is constant, whereby the modulation amplitude varies.

In order to prevent the above-mentioned problems in the prior art current driver circuit, it is necessary to cancel the variation in the modulation amplitude using a power supply voltage compensation circuit which monitors the output amplitude of the current driver circuit (for example, the output amplitude at the output terminal $\overline{OUT}$) and controls the input current $I_1$ in response to the variation in the output amplitude, as proposed in Japanese Published Patent Application No. Hei. 7-7204.

SUMMARY OF THE INVENTION

It is an object of the present invention to provide a current mirror circuit that can suppress an error in an output current in response to an output voltage even when the circuit comprises semiconductor elements having high drain conductances.

It is another object of the present invention to provide a signal processing circuit that can suppress a variation in a modulation amplitude without a power supply voltage compensation circuit.

Other objects and advantages of the invention will become apparent from the detailed description that follows. The detailed description and specific embodiments described are provided only for illustration since various additions and modifications within the scope of the invention will be apparent to those of skill in the art from the detailed description.

According to a first aspect of the present invention, a current mirror circuit comprises a current input terminal; a first FET and a second FET, each having a gate terminal, a drain terminal, and a source terminal, the gate terminal of the first FET being connected to the gate terminal of the second FET; a third FET having a source terminal connected to the drain terminal of the first FET, and a drain terminal and a gate terminal connected to each other and to the current input terminal; and a fourth FET having a source terminal connected to the drain terminal of the second FET, a gate terminal connected to the gate terminal of the third FET, and a drain terminal serving as a current output terminal. Therefore, when the current mirror circuit comprises FETs having high drain conductances, if the output voltage varies, since the current is almost constant, the circuit is not adversely affected by the variation in the output voltage. As a result, an error in the output current in response to the output voltage is significantly reduced.

According to a second aspect of the present invention, the current mirror circuit includes a positive power supply terminal; a negative power supply terminal; the source terminals of the first FET and the second FET being connected to each other and to the negative power supply terminal; a resistor having a first end connected to the source terminal of the first FET and a second end, opposite the first end, connected to the gate terminal of the first FET; a level shift circuit having a low potential end connected to the gate terminal of the first FET, and a high potential end; a fifth FET having a source terminal connected to the high potential end of the level shift circuit, a gate terminal connected to the gate terminal of the third FET, and a drain terminal connected to the positive side power supply terminal; and a current source connected between the positive power supply terminal and the current input terminal.

According to a third aspect of the present invention, the current mirror circuit includes a bypass capacitor connected between the gate terminal of the second FET and the ground. Therefore, the gate voltage of the second FET that is dominant in deciding the output current is made stable, so that distortion in the output current is sufficiently reduced even when the input current includes high frequency noise.

According to a fourth aspect of the present invention, the current mirror circuit includes a bypass capacitor connected between the gate terminal and the source terminal of the fourth field effect transistor. Therefore, the gate-source voltage of the fourth FET is kept constant for high frequencies, whereby the drain current of the fourth FET is kept constant and the gate-source voltage of the second FET is fixed in view of an equivalent circuit. So, even when the input current is modulated, distortion in the output current is reduced.

According to a fifth aspect of the present invention, a signal processing circuit comprises a signal processing circuit body including a differential amplifier for differentially amplifying an input signal; and a constant current source for supplying a constant current to the signal processing circuit body, the constant current source comprising the above-mentioned current mirror circuit. In this case, the modulation current does not depend on the drain conductances of the FETs but depends on the ratio in the gate widths between the FETs, so that the modulation current is controlled with high accuracy, and the production yield of the circuit is improved. Further, when the power supply voltage varies, since the variations in the voltages at the node between the first FET and the second FET and at the node between the second FET and the fourth FET are approximately equal to the variation in the power supply voltage, the output current does not vary even though the voltage at the output terminal of the current mirror circuit varies. Therefore, a compensating circuit is dispensed with, and the size of the circuit is reduced.

According to a sixth aspect of the present invention, the signal processing circuit body comprises an input buffer for amplifying a pair of input signals and outputting a pair of output signals; and an open drain circuit including a pair of differential field effect transistors receiving the output signals from the input buffer, the field effect transistors having source terminals connected to each other. Further, the constant current source supplies a constant current to the source terminals of the differential field effect transistors.

DETAILED DESCRIPTION OF THE PREFERRED EMBODIMENTS

Embodiment 1

Figure 1:
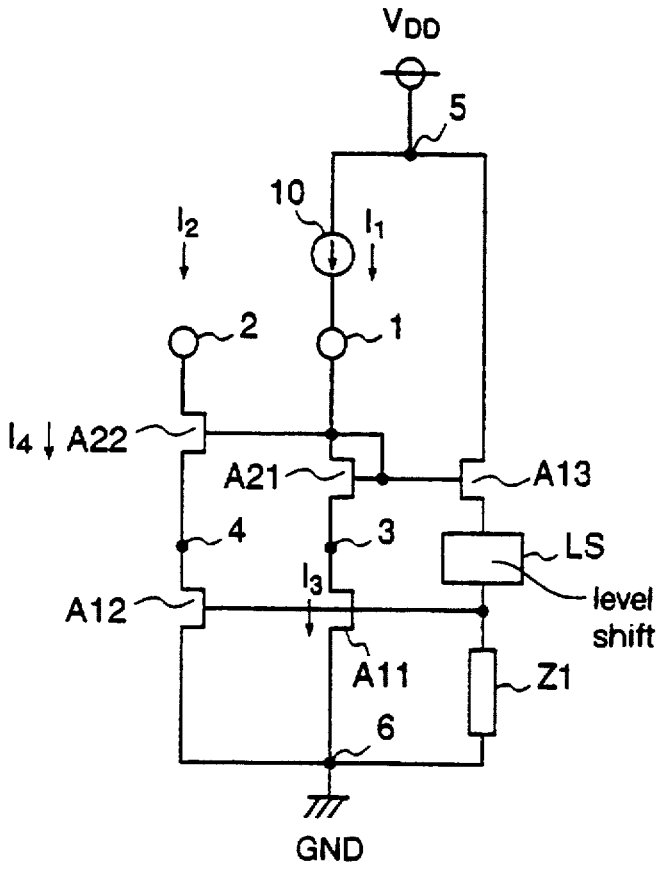
FIG. 1 is a diagram illustrating a current mirror circuit in accordance with a first embodiment of the present invention.

FIG. 1 is a diagram illustrating a current mirror circuit in accordance with a first embodiment of the present invention. In the figure, the current mirror circuit includes an input terminal $I_1$ through which a current $I_1$ flows, an output terminal 2 receiving a current $I_2$ proportional to the current $I_1$, a power supply terminal 5 to which a positive power supply voltage $V_{DD}$ is applied, a power supply terminal 6 to which a negative power supply voltage is applied, and a current source 10 supplying the current $I_1$. The power supply terminal 6 is connected to the ground GND. Further, the current mirror circuit includes enhancement type MESFETs A11, A12, A21, and A22, a level shift circuit LS, and a resistor Z1. The MESFETs A11, A12, A21, and A22 are formed in a GaAs IC or the like and have the same gate length and the same threshold voltage $V_{th}$. The level shift circuit LS comprises a single diode or a plurality of diodes connected in series. For example, when the forward bias voltage of the diode is 0.6 V, the level shift circuit comprises one diode or two diodes. The resistor Z1 is set at a value in a range from 200Ω to 1 kΩ when a current of 1 mA flows through the resistor Z1.

In this current mirror circuit, all the FETs have the same gate length and the same threshold voltage $V_{th}$. The drain terminal and the gate terminal of the FET A21 are short-circuited, and the gate terminal is connected to the gate terminal of the FET A13. A source terminal of the FET A21 is connected to a drain terminal of the FET A11. The drain terminal of the FET A22 is connected to the output terminal 2, the gate terminal thereof is connected to the drain terminal and the gate terminal of the FET A21 and to the gate terminal of the FET A13, and the source terminal thereof is connected to a drain terminal of the FET A12.

Further, the source terminal of the FET A11 is connected to the power supply terminal 6. An end of the resistor Z1 (first end) is connected to a node between the gate terminals of the FETs A11 and A12 and a low potential end of the level shift circuit LS, and the other end (second end) is connected to the power supply terminal 6. The drain terminal of the FET A13 is connected to the power supply terminal 5, and a gate terminal thereof is connected to the drain terminal and the gate terminal of the FET A21 and to the gate terminal of the FET A22. A high potential end of the level shift circuit LS is connected to the source terminal of the FET A13, and a low potential end thereof is connected to a node between the first end of the resistor Z1 and the gate terminals of the FETs A11 and A12. Further, the gate terminal of the FET A12 is connected to the gate terminal of the FET A11 and to a node between the low potential end of the level shift circuit LS and the first end of the resistor Z1, and a source terminal thereof is connected to the negative voltage supply terminal 6. The power supply terminal 5 is connected to a power supply generating a power supply voltage $V_{DD}$, and the negative voltage supply terminal 6 is connected to the ground GND. Furthermore, the current supply 10 is connected between the power supply terminal 5 and the input terminal 1.

A description is given of the operation. The ratio of the gate width of the FET A11 to the gate width of the FET A12 is equal to the ratio of the gate width of the FET A21 to the gate width of the FET A22. Since the FET A21 is an enhancement type FET having the threshold voltage about 0 V and the gate and the drain of the FET A21 are short-circuited, it operates in a saturation region ($0<V_{gs}-V_{th}\leqq V_{ds}$). Therefore, the same gate bias as that applied to the gate electrode of the FET A21 is applied to the gate electrode of the FET A22 which is connected to the gate electrode of the FET A21, so that the FET A22 also operates in the saturation region.

Further, the FET A11 is originally set so as to operate in the saturation region by the resistor Z1, the level shift circuit LS, and the FET A13. Since the gate electrode of the FET A11 is connected to the gate electrode of the FET A12, the same gate bias as that applied to the FET A11 is applied to the FET A12, so that the FET A12 also operates in the saturation region.

Figure 2:
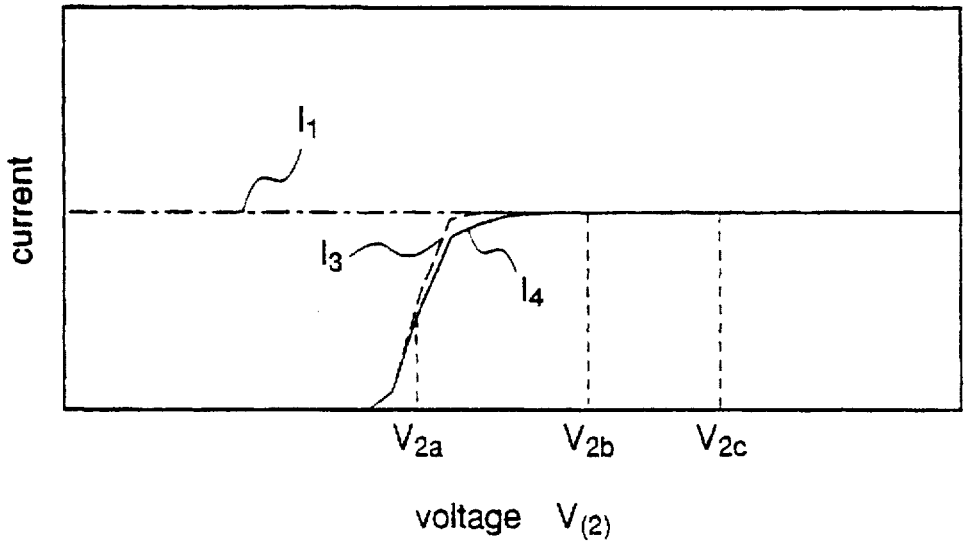
FIGS. 2(*a*) and 2(*b*) are diagrams for explaining DC characteristics of the current mirror circuit according to the first embodiment.
Figure 2:
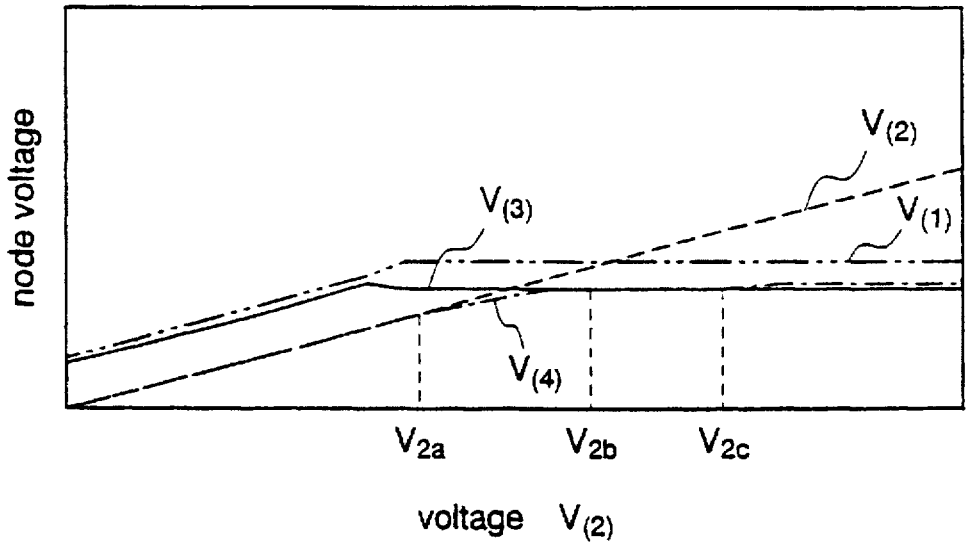

FIGS. 2(*a*) and 2(*b*) are diagrams for explaining output current characteristics of the current mirror circuit shown in FIG. 1. These figures show variations in current and voltage when the voltage at the output terminal $V_2$ varies and the input current $I_1$ is constant. Hereinafter, a node between the drain terminal of the FET A11 and the source terminal of the FET A21 is denoted by 3, and a node between the drain terminal of the FET A12 and the source terminal of the FET A22 is denoted by 4 as shown in FIG. 1. In addition, the ratio of the gate width of the FET A11 to the gate width of the FET A12 is 1:1.

FIG. 2(*a*) shows the respective currents flowing in the circuit, and FIG. 2(*b*) shows the relationship between voltages at the nodes 3 and 4 and the output voltage. Initially, in a region where the terminal voltage $V_{(2)}$ at the output terminal 2 is not higher than 0.6 V, the terminal voltage $V_{(1)}$, i.e., the gate voltage of the FET A22, is higher than the terminal voltage $V_{(2)}$, i.e., the drain voltage of the FET A22, and the input current $I_1$ flows as a diode current between the gate and the drain of the FET A22 which has the lowest impedance at this time, so that the current $I_3$ does not flow through the node 3. Thereby, the terminal voltage $V_{(3)}$ at the node 3, i.e., the terminal voltage $V_{(1)}$ at the input terminal 1, has an offset equivalent to a forward current rising voltage in the diode characteristics of the FET. This offset is about 0.6 V in the figure. The terminal voltage $V_{(1)}$ and the terminal voltage $V_{(3)}$ increase while maintaining the offset voltage with an increase in the terminal voltage $V_{(2)}$ at the output terminal 2. After the terminal voltage $V_{(2)}$ exceeds about 0.7 V, a current flows through a path comprising the FET A13, the level shift circuit LS, and the resistor Z1 in response to the gate-source voltage of the FET A13, and the gate voltages of the FETs A11 and A12 increase. When the FETs A11 and A12 turn on and their impedances are reduced, the drain current flows through this path and, simultaneously, a current flows between the drain and the source of the FET A21 and between the drain and the source of the FET A22. When the terminal voltage $V_{(2)}$ at the output terminal 2 becomes equal to the terminal voltage $V_{(1)}$ at the input terminal 1 (in FIG. 2(*b*), $V_{(2)}=V_{2b}$), $0<V_{gs}-V_{th}$ and $V_{gs}=V_{ds}$ are satisfied, so that the FET A22 operates in the saturation region. Since the same gate bias as the gate bias applied to this FET A22 is applied to the FET A21, the FET A21 operates in the saturation region. Since the FETs A22 and A21 have the same gate width, a current $I_2$ equal to the current $I_1$ flows through the FET A21, and a voltage equal to the drain-source voltage of the FET A22 produced by the flow of the current $I_2$ through the FET A22 appears between the drain and the source of the FET A21. Then, a current equal to the current $I_1$ flowing through the FET A21 flows through the FET A11, and a current equal to the current $I_2$ flowing through the FET A22 flows through the FET A12. Therefore, a cascade circuit comprising the FETs A11 and A21 and a cascade circuit comprising the FETs A12 and A22 operate under the condition that these FETs have the same drain-source voltage and the same gate bias voltage.

When these FETs A11, A12, A21, and A22 operate under the same condition mentioned above, $V_{(3)}$ is equal to $V_{(4)}$ and $I_1$ is equal to $I_2$, and the FETs A21 and A22 operate as a buffer for the FETs A11 and A12.

This buffer functions as follows. That is, as illustrated in FIG. 2(*b*), when $V_{(2)}$ exceeds $V_{2b}$ and increases, if the drain conductance of the FET A22 is $G_d$ and the transconductance thereof is $G_m(=\Delta I_{ds}\cdot\Delta V_{gs})$, a variation $\Delta V_4$ in the drain voltage of the FET A12 is represented by $$\Delta V_4=(G_d/G_m)\cdot\Delta V_2$$

Since $G_d/G_m$ ranges from one and several-tenths to one and one tenth in a GaAs MESFET, the voltage $V_{(4)}$ at the node 4 hardly changes though the output terminal voltage $V_{(2)}$ increases.

Therefore, even in a range of $V_{(2)}>V_{(1)}$ (for example, $V_{2c}$ in FIG. 2(*b*)), since $V_{(4)}$ is equal to $V_{(3)}$, $I_1=I_2$ is realized. As a result, an output current resistant to variations in the voltage at the output terminal 2 and proportional to the input current is obtained.

As described above, in the current mirror circuit according to the first embodiment of the invention, since the reference current $I_1$ and the output current $I_2$ do not depend on the drain conductance $G_d$ of the FET but depend on the gate width of the FET, the current controllability is significantly improved. Further, since the current mirror circuit includes two cascade circuits, each comprising two MESFETs connected in series, a constant current flows even when the output terminal voltage $V_{(2)}$ varies, whereby an output current resistant to variations in the voltage at the output terminal and proportional to the input current can be obtained.

Although enhancement type MESFETs are employed in this first embodiment, depletion type MESFETs may be employed with the same effects as described above.

Embodiment 2

Figure 3:
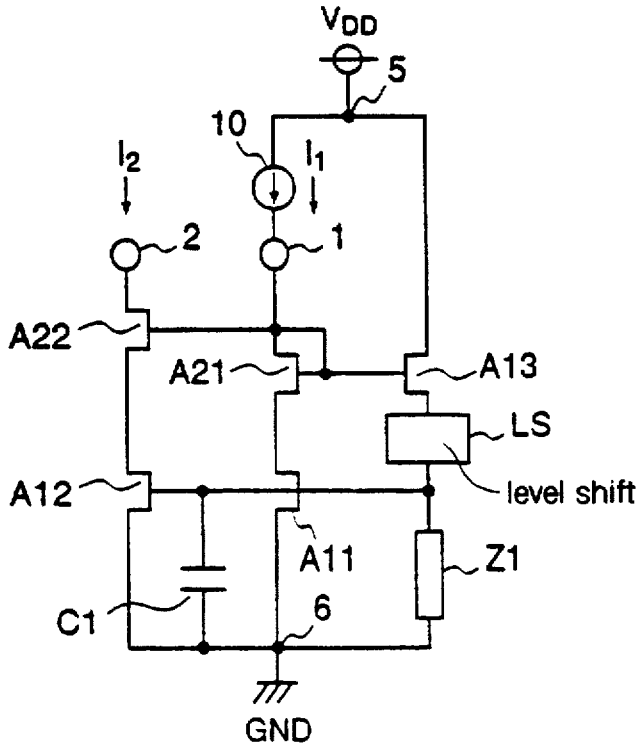
FIG. 3 is a diagram illustrating a current mirror circuit in accordance with a second embodiment of the present invention.

FIG. 3 is a diagram illustrating a current mirror circuit in accordance with the second embodiment of the present invention. The current mirror circuit shown in FIG. 3 is fundamentally identical to the current mirror circuit according to the first embodiment except that a capacitor C1 is connected between the gate terminal of the FET A12 and the ground.

In the first embodiment of the invention, it is assumed that the input current $I_1$ applied to the input terminal 1 is a constant current. In an actual IC, however, a high frequency component $i_1$ is superposed on the input current $I_1$ because of power supply noise. In the current mirror circuit, the high frequency component $i_1$ in the input current $I_1$ is amplified by the ratio m (m>0) of the gate widths between the FETs, and a high frequency component $i_2$ $(=m\cdot i_1)$ is superposed on the output current $I_2$, resulting in distortion in the output current.

By the way, in the current mirror circuit according to the first embodiment, the output current $I_2$ depends on both the gate voltage and the drain voltage of the FET A12, but the variation in the gate voltage dominates the output current distortion because a relationship of $\Delta I_{ds}$=drain conductance $G_d\cdot\Delta V_{ds}$ stands between the variation in the drain-source voltage of the FET ($\Delta V_{ds}$) and the variation in the output current ($\Delta I_{ds}$) whereas a relationship of $\Delta I_{ds}$= transconductance $G_m\cdot\Delta V_{gs}$ stands between the variation in the gate-source voltage of the FET ($\Delta V_{gs}$) and the variation in the output current and, therefore, $G_m>>G_d$.

In this second embodiment of the invention, since the bypass capacitor C1 is connected between the gate terminal of the FET A12 and the ground GND, the variation in the gate voltage is suppressed, whereby the output current distortion is significantly reduced.

Embodiment 3

Figure 4:
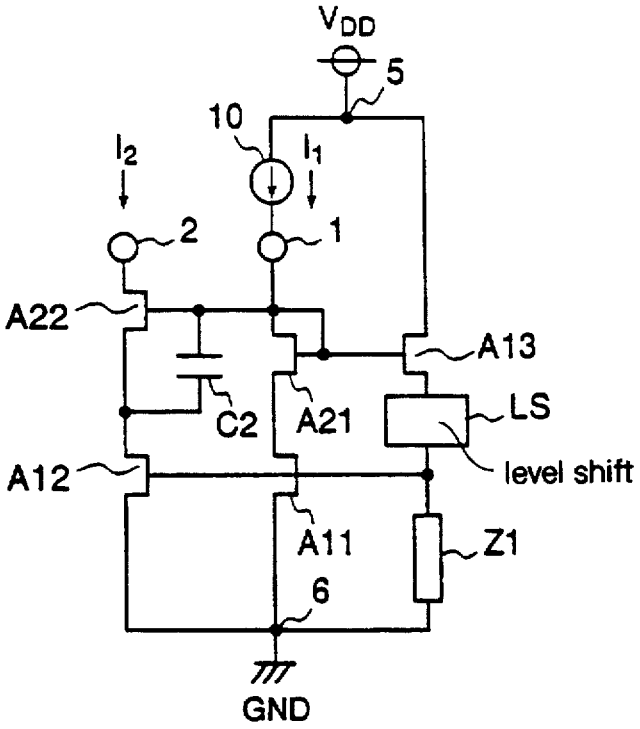
FIG. 4 is a diagram illustrating a current mirror circuit in accordance with a third embodiment of the present invention.

FIG. 4 is a diagram illustrating a current mirror circuit in accordance with a third embodiment of the present invention. The current mirror circuit shown in FIG. 4 is fundamentally identical to the current mirror circuit according to the first embodiment except that a capacitor C2 is connected to the current input terminal 1 at one end and to a node between the source terminal of the FET A22 and the drain terminal of the FET A12 at the other end.

When the bypass capacitor C1 is used in the second embodiment of the invention, the drain-source current of the FET A12 is kept constant, whereby the drain-source current of the FET A22 is kept constant. In other words, the gate-source voltage of the FET A22 is kept constant. Therefore, when the bypass capacitor C2 is connected between the gate and the source of the FET A22, the gate-source voltage of the FET A22 is kept constant for high frequencies, and the drain current of the FET A22 is made constant, whereby the gate-source voltage of the FET A12 is fixed from the point of view of an equivalent circuit.

In this way, the bypass capacitor C2 reduces distortion in the output current when the input current is subjected to a modulation.

Embodiment 4

Figure 5:
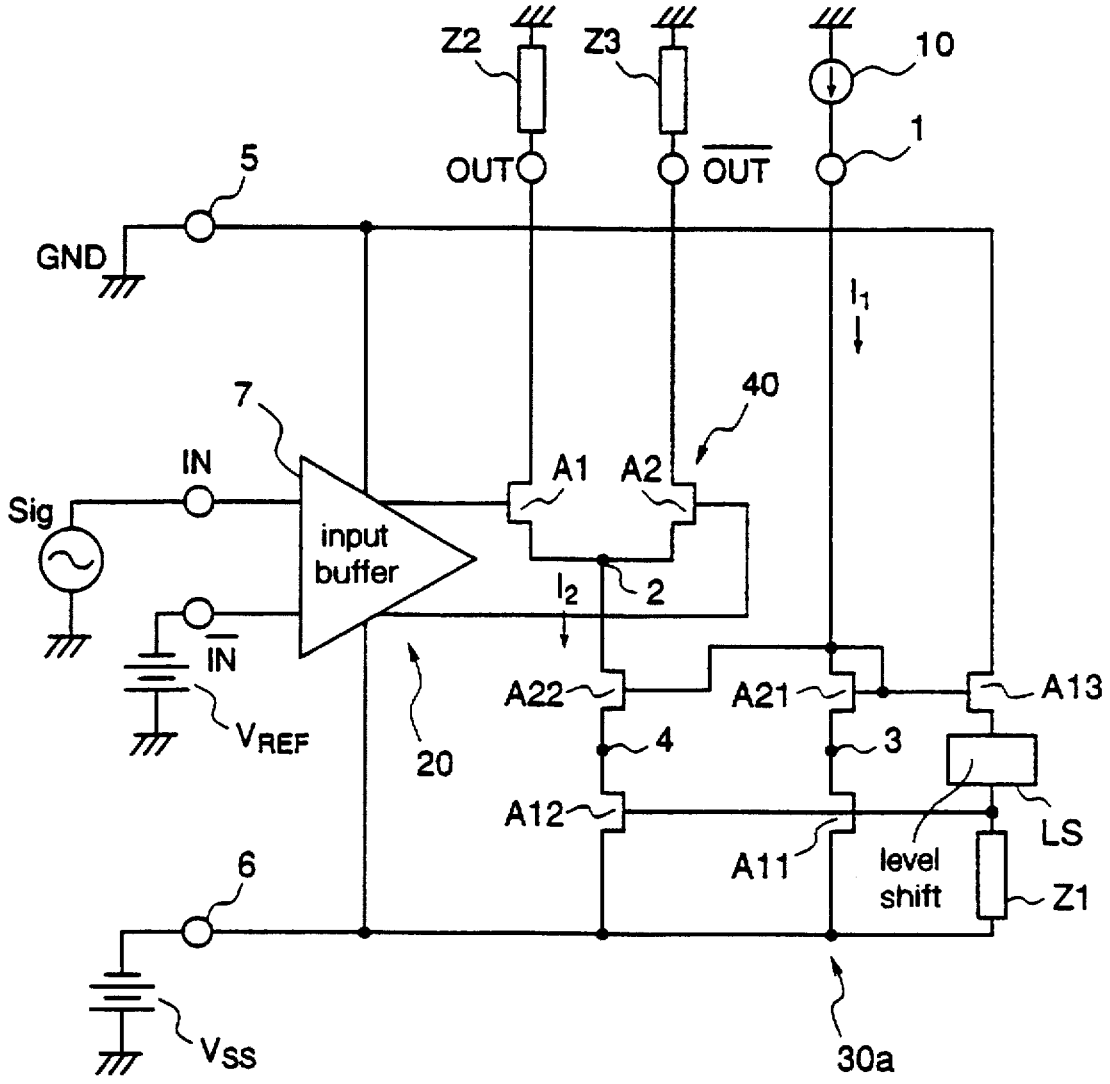
FIG. 5 is a diagram illustrating a current driver circuit employing the current mirror circuit shown in FIG. 1 as a constant current source, according to a fourth embodiment of the present invention.

FIG. 5 is a diagram illustrating an open drain type current driver circuit employing a current mirror circuit according to the first embodiment of the invention as a constant current source for a differential circuit.

The current driver circuit shown in FIG. 5 is used in optical communication systems as a driving circuit for a laser diode that converts a current signal to a light signal or a driving circuit for a light modulator that switches transmission and absorption of light in response to an input voltage. In this case, since the ratio of the magnitude of modulation current to the light output is about 1:1, the modulation current must be controlled accurately to obtain a specified average light output and extinction coefficient.

In FIG. 5, FETs A1 and A2 are a differential pair of transistors, source terminals of which are connected to each other. In addition, these FETs A1 and A2 form an open drain circuit 40, i.e., drain terminals thereof are connected to output terminals OUT and $\overline{\text{OUT}}$ of the current driver circuit, respectively. Further, a load resistor Z2 is connected between the output terminal OUT and the ground terminal GND, and a load resistor Z3 is connected between the output terminal $\overline{\text{OUT}}$ and the ground terminal GND. An input buffer 7 comprises a differential amplifier (not shown) and a level shift circuit (not shown) and amplifies a pair of input signals to amplitudes required for inputs of the open drain circuit 40, i.e., gate inputs of the FETs A1 and A2. A current driver circuit (signal processing circuit) 20 comprises the input buffer 7 and the open drain circuit 40. A constant current source 30*a* comprises a current mirror circuit identical to the current mirror circuit shown in FIG. 1, and a voltage at the output terminal 2 of the current mirror circuit is equal to a difference between the output level of the output OUT ($\overline{OUT}$) from the input buffer 7 and the gate-source voltage of the FET A1 (FET A2). Furthermore, the current driver circuit includes a power supply terminal 5 connected to the ground GND and a power supply terminal 6 connected to a negative terminal of a power supply $V_{SS}$. A positive terminal of the power supply $V_{SS}$ is connected to the ground GND.

A description is given of the operation. When a current $I_1$ is supplied from the current source 10 to the input terminal 1, a current $I_2$ proportional to the current $I_1$ flows through the source terminals of the FETs A1 and A2 constituting the open drain circuit 40. The positive phase input terminal IN of the input buffer 7 is connected to a signal source Sig, and the opposite phase input terminal $\overline{IN}$ of the input buffer 7 is connected to a negative terminal of a reference voltage supply $V_{REF}$. An input signal from the signal source Sig is amplified in the input buffer 7, whereby the FET A1 and the FET A2 alternatingly turn ON and OFF in response to the levels (high and low) of the signal from the signal source Sig and the reference voltage from the reference voltage supply $V_{REF}$. By the alternating ON and OFF switching of the FETs A1 and A2, the current path of the current $I_2$ is changed, and a modulation current having an amplitude equivalent to that of the current $I_2$ is output from the output terminals OUT and $\overline{OUT}$.

In this current driver circuit, the input signal Sig is a sinusoidal wave of 10 GHz. The gate width of the FET A11 is 200 μm, and the gate width of the FET A12 is 600 μm.

Figure 6:
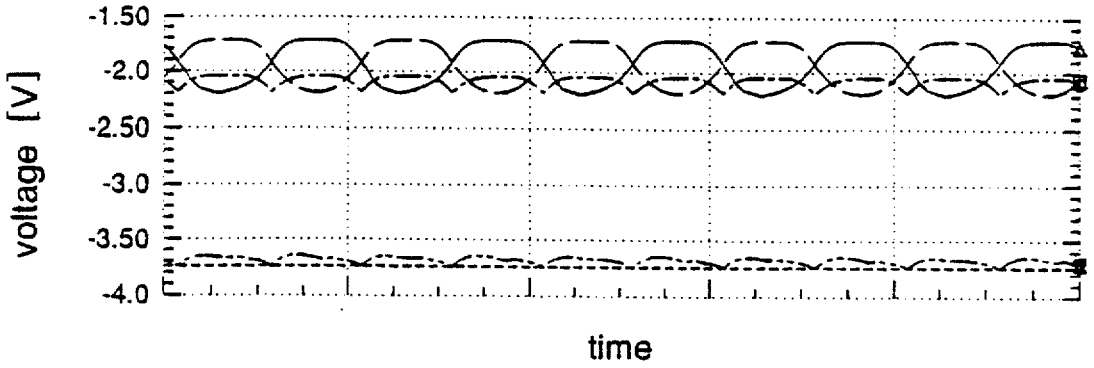
FIGS. 6(*a*) and 6(*b*) are diagrams illustrating node voltages and input and output currents, respectively, in the current driver circuit shown in FIG. 5, and FIG. 6(*c*) is a diagram illustrating an output current from the current driver circuit shown in FIG. 5.
Figure 6:
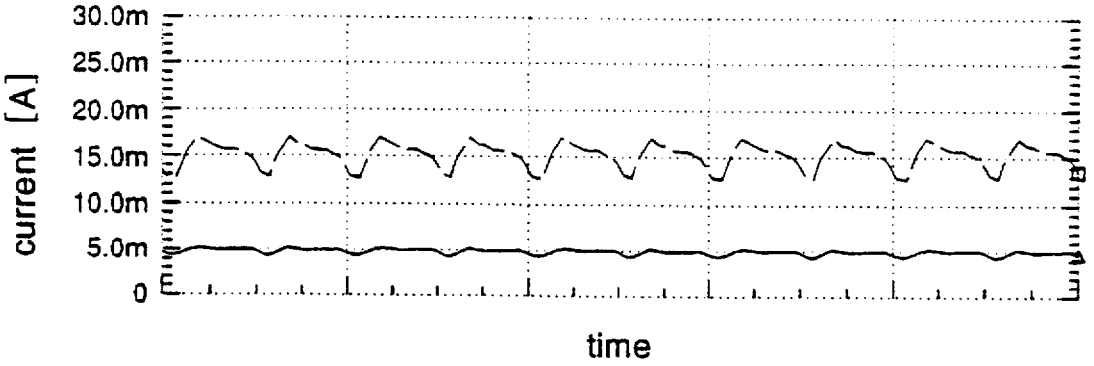
Figure 6:
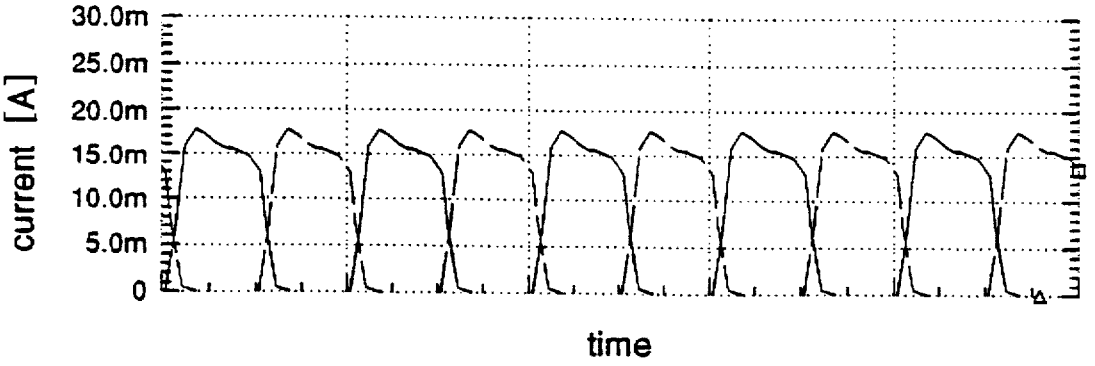

FIG. 6(*a*) shows the node voltages in the current mirror circuit 30*a*, wherein the solid line and the dashed line show the signals input to the current mirror circuit from the input buffer 7, the alternating long and short dash line shows the output terminal voltage $V_{(2)}$, the alternating long dash and two short dashes line shows the drain voltage $V_{(4)}$ of the FET A12, and the dotted line shows the drain voltage $V_{(3)}$ of the FET A11. In the driver circuit according to this fourth embodiment, the drain voltage of the FET A11 is almost equal to the drain voltage of the FET A12. FIG. 6(*b*) shows the input current $I_1$ and the output current $I_2$ of the current mirror circuit, wherein the solid line shows the input current $I_1$ (=5 mA) and the dashed line shows the output current $I_2$. FIG. 6(*c*) shows waveforms of output currents from the output terminals OUT and $\overline{OUT}$ of the current driver circuit. The drain voltage $V_{(3)}$ is almost equal to the drain voltage $V_{(4)}$, and the current $I_2$ is output from the current mirror circuit in response to the ratio of the size of the FET A11 to the size of the FET A12 (1:3), i.e., the output current $I_2$ is 15 mA. As a result, in the current driver circuit, an error of the output current amplitude from the set value is less than several percent.

Figure 7:
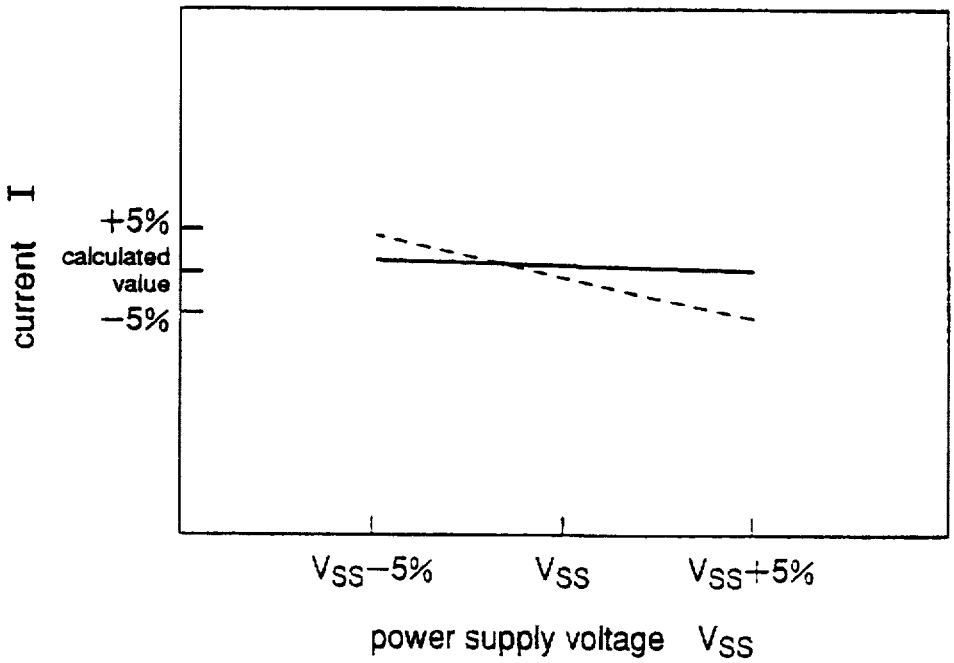
FIG. 7 is a diagram illustrating modulation current characteristics of the current driver circuit according to the fourth embodiment in comparison with modulation current characteristics of a prior art current driver circuit.

FIG. 7 is a diagram for explaining the dependence of the modulation current $I_2$ on the power supply voltage. In the figure, the solid line shows the modulation current obtained in the current driver circuit according to this fourth embodiment, and the dotted line shows the modulation current obtained in the prior art current driver circuit including no power supply voltage compensating circuit. In addition, the calculated current value on the ordinate is a value obtained from the reference current $I_1$ and the ratio of the gate width of the FET A11 to the gate width of the FET A12.

In FIG. 7, when the supply voltage $V_{SS}$ varies by ±5%, the current $I_2$ also varies by about ±5% in the prior art circuit. However, in the circuit according to this fourth embodiment using the same FET parameters, the current $I_2$ is almost constant and approximates the calculated value.

Figure 8:
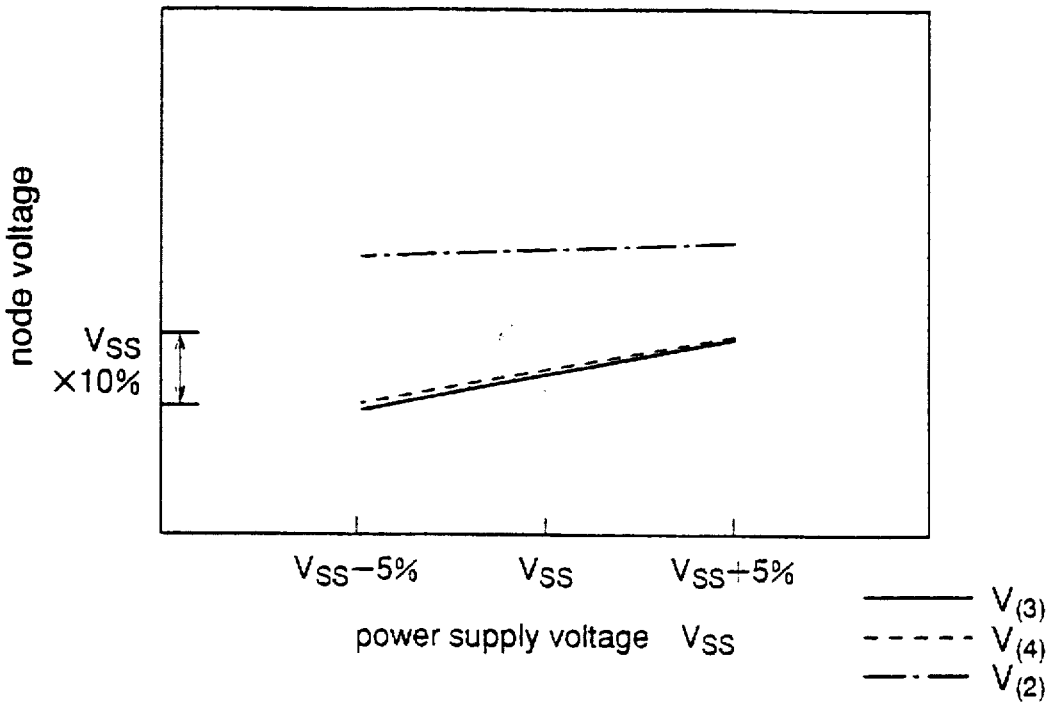
FIGS. 8(*a*) and 8(*b*) are diagrams illustrating voltage characteristics at nodes in the current driver circuit according to the fourth embodiment.
Figure 8:
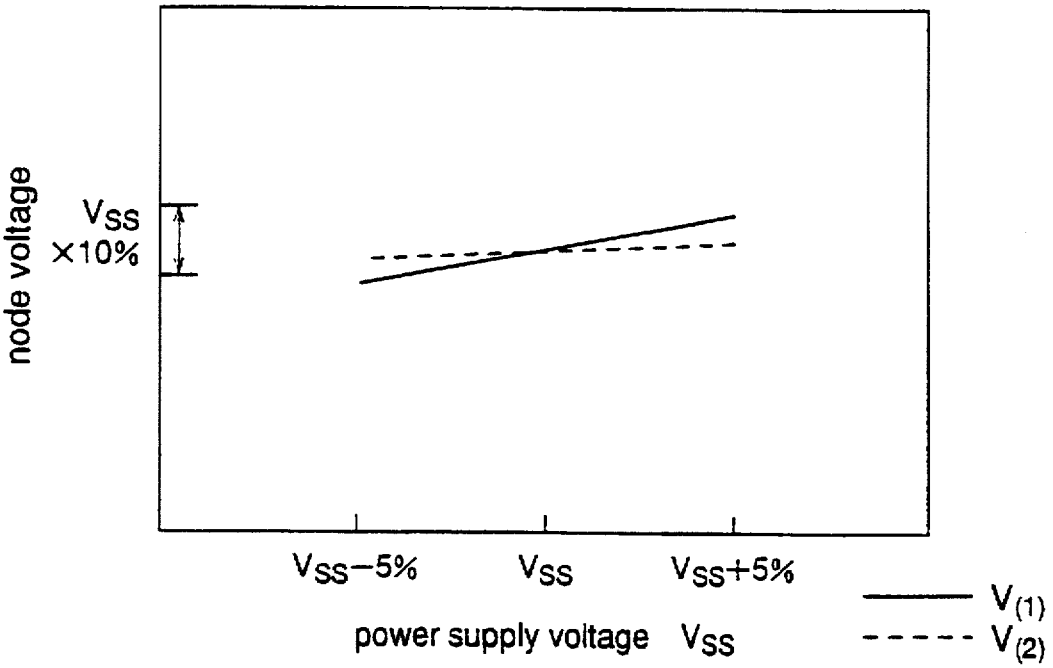
Figure 14:
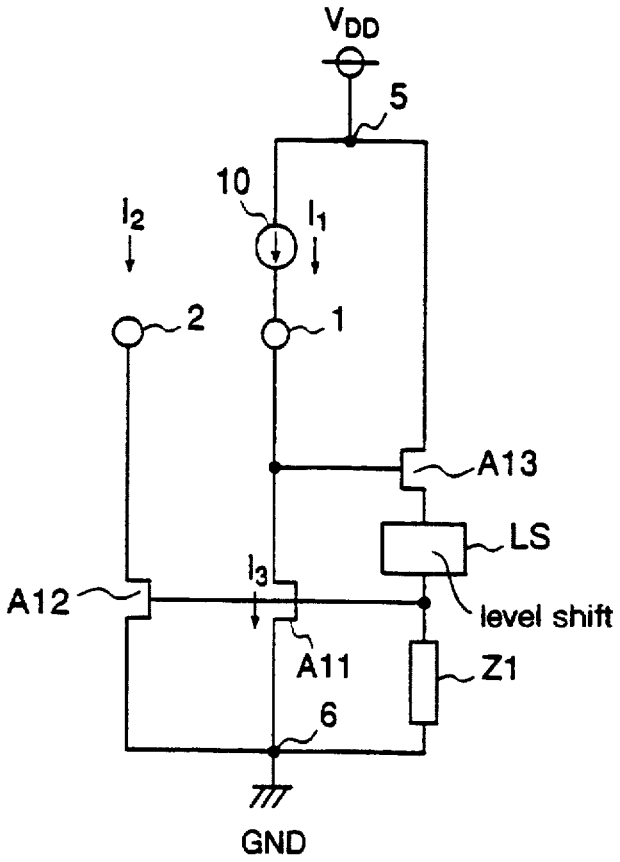
Fig.14 Prior Art
FIG. 14 is a diagram illustrating a prior art current mirror circuit.
Figure 15:
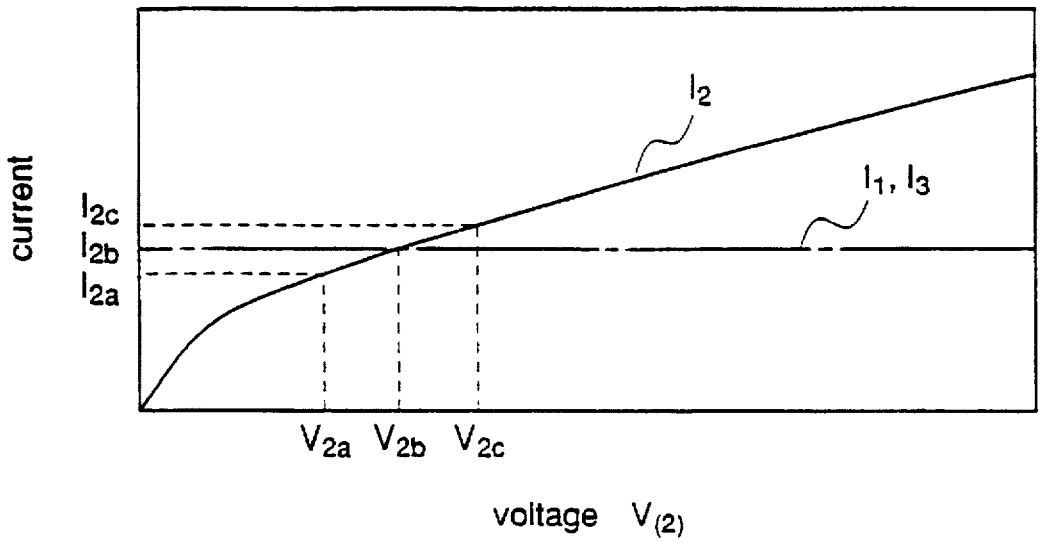
Prior Art Fig.15 (a)
FIGS. 15(*a*) and 15(*b*) are diagrams for explaining DC characteristics of the prior art current mirror circuit.
Figure 15:
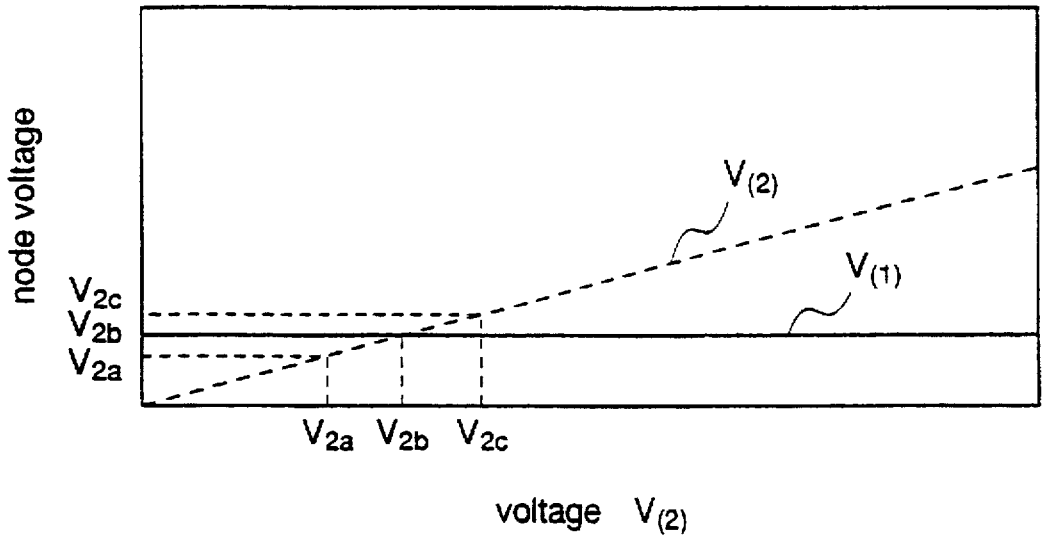
Figure 16:
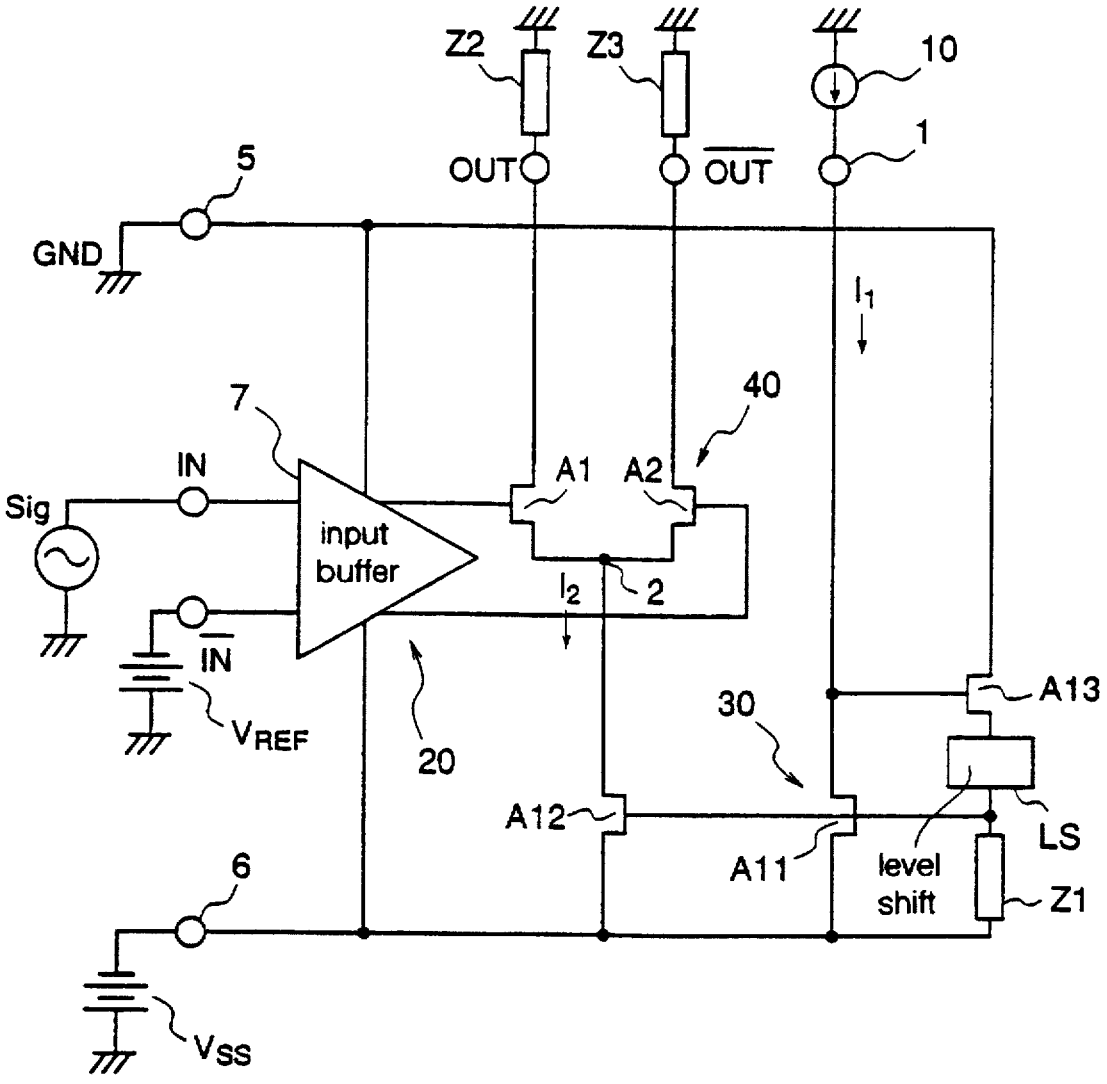
Fig.16 Prior Art
FIG. 16 is a diagram illustrating a prior art current driver circuit employing the current mirror circuit shown in FIG. 14.
Figure 17:
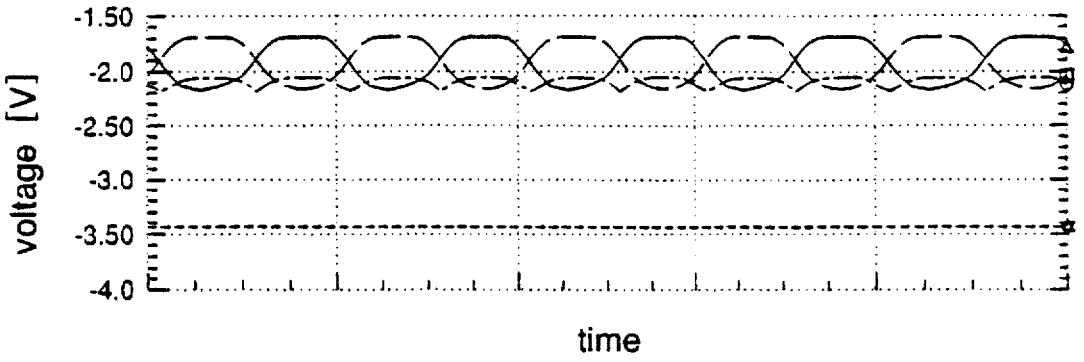
Prior Art Fig.17 (a)
FIGS. 17(*a*) and 17(*b*) are diagrams illustrating node voltages and input and output currents, respectively, in the current driver circuit shown in FIG. 16, and FIG. 17(*c*) is a diagram illustrating an output current from the current driver circuit shown in FIG. 16.
Figure 17:
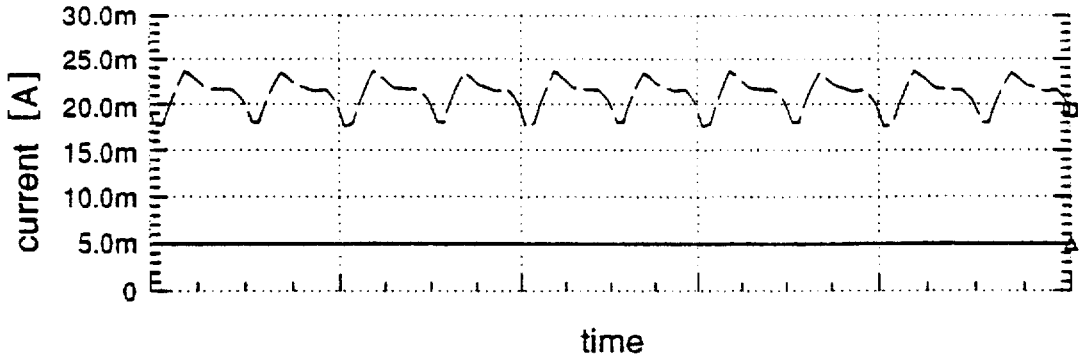
Figure 17:
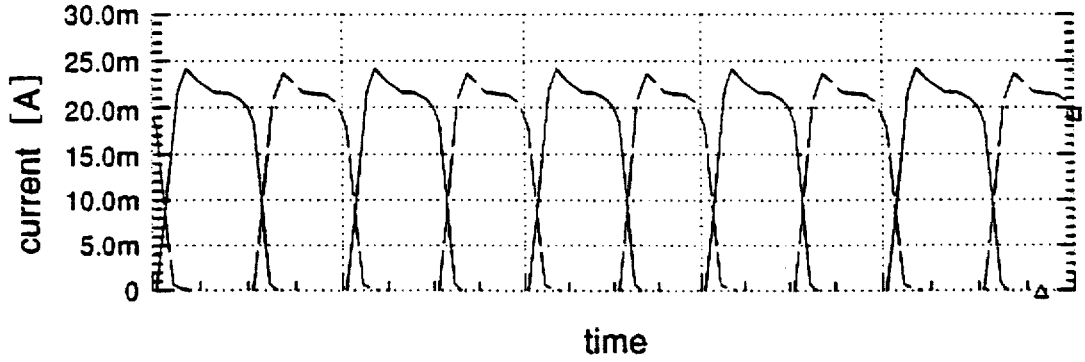

FIGS. 8(*a*) and 8(*b*) are diagrams illustrating variations in the node voltages in the current mirror circuit when the power supply voltage varies. In the prior art circuit, as shown in FIG. 8(*b*), when the power supply voltage $V_{SS}$ varies by ±5%, the voltage $V_{(1)}$ at the node 1 (see FIG. 14) increases or decreases in response to the variation in the power supply voltage, i.e., it varies in a range of $V_{SS}$×10%. Therefore, the voltage difference $V_{(1)}-V_{SS}$, i.e., the drain-source voltage of the reference FET A11 hardly varies. However, since the voltage $V_{(2)}$ at the node 2 (see FIG. 14) is almost constant regardless of the variation in the power supply voltage, the drain-source voltage of the FET A12 varies. As a result, the output current $I_2$ varies.

On the other hand, in the current driver circuit according to this fourth embodiment, as shown in FIG. 8(*a*), although the voltage at the node 1 is constant as in the prior art circuit, since the drain voltages of both the FET A11 and the FET A12 increase or decrease with a variation in the power supply voltage, the drain-source voltages of these FETs are always constant. Therefore, the ratio of the current $I_1$ to the current $I_2$ is constant even when the power supply voltage varies.

In this fourth embodiment of the invention, a current mirror circuit according to the first embodiment of the invention is used as a constant current source 30*a* for the current driver circuit 20 comprising the input buffer 7 and the open drain circuit 40, and a current output terminal of the current mirror circuit is connected to the sources of the MESFETs A1 and A2 constituting the open drain circuit 40. Therefore, the modulation current does not depend on the drain conductances of the FETs but depends on the gate width ratio between the FETs, whereby the current controllability is improved and the production yield of the circuit is increased. Further, when the power supply voltage $V_{SS}$ varies, since variations in voltages at the nodes 3 and 4 are almost equal to the variation in the power supply voltage, the output current from the current mirror circuit does not vary even when the voltage at the output terminal 2 of the current mirror circuit varies. Therefore, a circuit for compensating the variation in the voltage at the output terminal is not necessary, resulting in a reduction in the circuit size.

Embodiment 5

Figure 9:
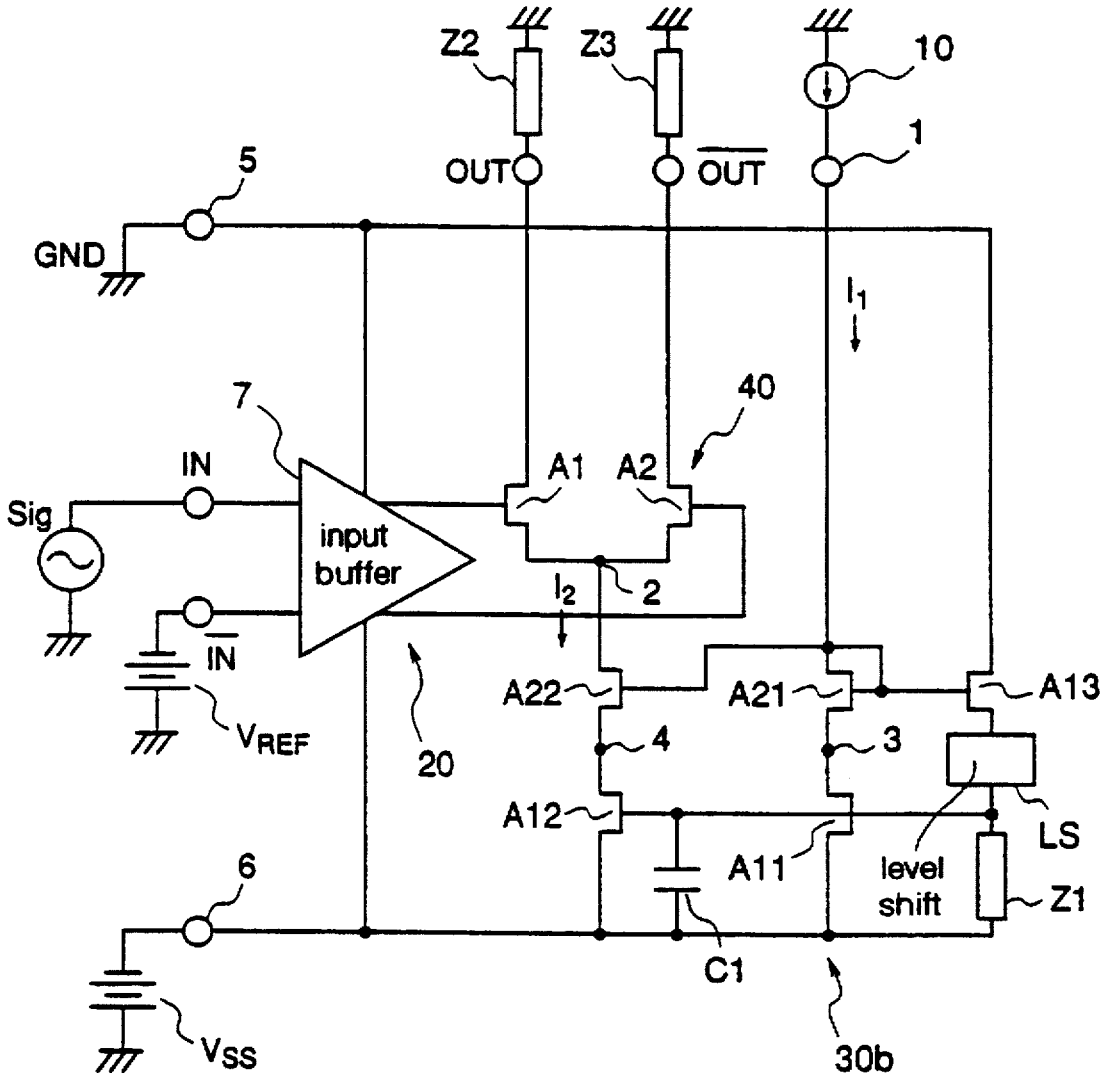
FIG. 9 is a diagram illustrating a current driver circuit employing the current mirror circuit shown in FIG. 3 as a constant current source, according to a fifth embodiment of the invention.

FIG. 9 is a diagram illustrating an open drain type current driver circuit employing a current mirror circuit according to the second embodiment of the invention as a constant current source for a differential circuit, according to a fifth embodiment of the present invention.

In the figure, reference numeral 30*b* designates a constant current source comprising a current mirror circuit similar to the current mirror circuit shown in FIG. 3. In the current mirror circuit, the voltage at the output terminal 2 is equal to a difference between the output level at the output terminal OUT ($\overline{OUT}$) of the input buffer 7 and the gate-source voltage of the FET A1 (FET A2).

In the constant current source 30*b*, a bypass capacitor C1 is connected between the gate terminal of the FET A12 and the ground GND, whereby distortion in output current characteristics is reduced.

In an actual IC, a high frequency component $i_1$ is superposed on the input current $I_1$ because of power supply noise. In the current mirror circuit, the high frequency component $i_1$ in the input current $I_1$ is amplified by the ratio m (m>0) of the gate widths between the FETs, and a high frequency component $i_2$ (=m·$i_1$) is superposed on the output current $I_2$, resulting in distortion in the output current.

Figure 10:
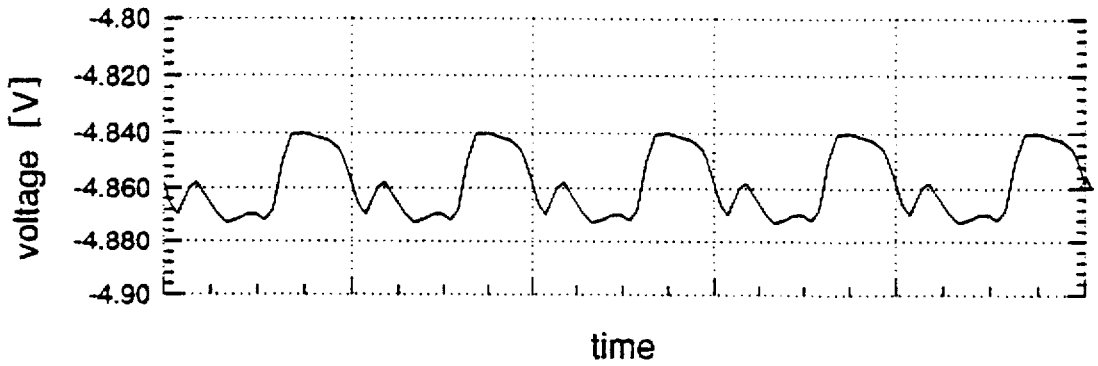
FIGS. 10(*a*) and 10(*b*) are diagrams illustrating node voltages and input and output currents, respectively, in the current driver circuit shown in FIG. 5, and FIG. 10(*c*) is a diagram illustrating an output current from the current driver circuit shown in FIG. 5, when a high frequency component is superposed on an input current of the current driver circuit.
Figure 10:
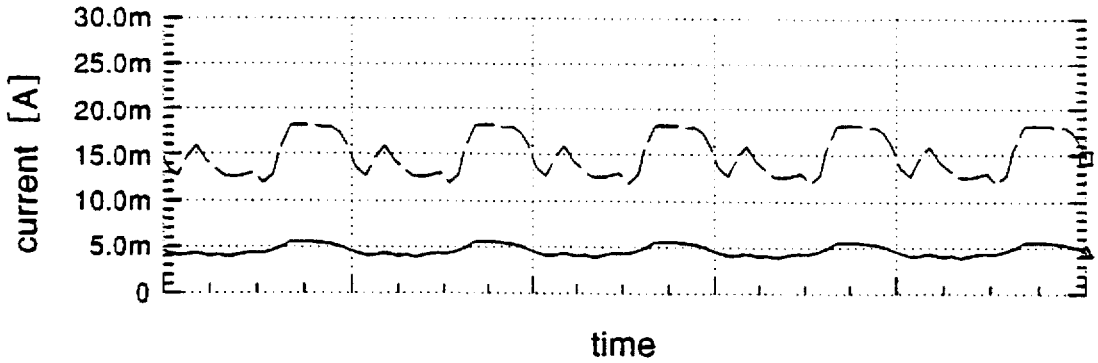
Figure 10:
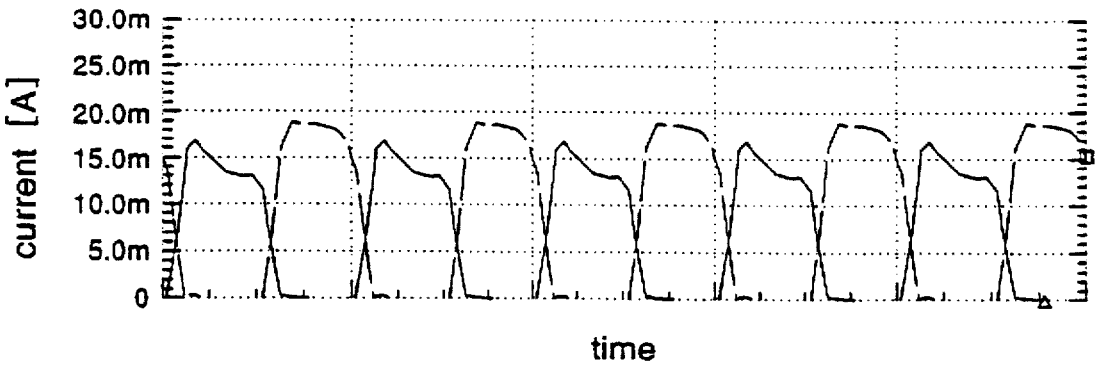

FIGS. 10(*a*), 10(*b*), and 10(*c*) are diagrams illustrating the node voltage, the input and output currents $I_1$ and $I_2$, and the output current from the driver circuit, respectively, when a high frequency component is superposed on the input current $I_1$ in the current mirror circuit of the current driver circuit according to the fourth embodiment. The input signal Sig is a sinusoidal wave of 10 GHz. The gate width of the FET A11 in the current mirror circuit is 200 μm, and the gate width of the FET A12 is 600 μm. The input current $I_1$ is 5 mA, and the high frequency component is a ±1 mA sinusoidal wave at 10 GHz. FIG. 10(*a*) shows the gate voltage of the FET A12. This gate voltage varies by about 35 mV due to the high frequency component in the input current $I_1$. FIG. 10(*b*) shows the input current $I_1$ and the output current $I_2$ of the current mirror circuit, wherein the solid line shows the input current $I_1$ (=5±1 mA) and the dashed line shows the output current $I_2$ from the current mirror circuit. FIG. 10(*c*) shows the output current waveform from the output terminals OUT and $\overline{OUT}$ of the driver circuit. The variation in the output current $I_2$ from the current mirror circuit is ±3 mA (=±1 mA×3) in response to the ratio m (=3) of the gate widths of the FET A11 and the FET A12, resulting in an asymmetric waveform of the output current amplitude from the driver circuit.

Figure 11:
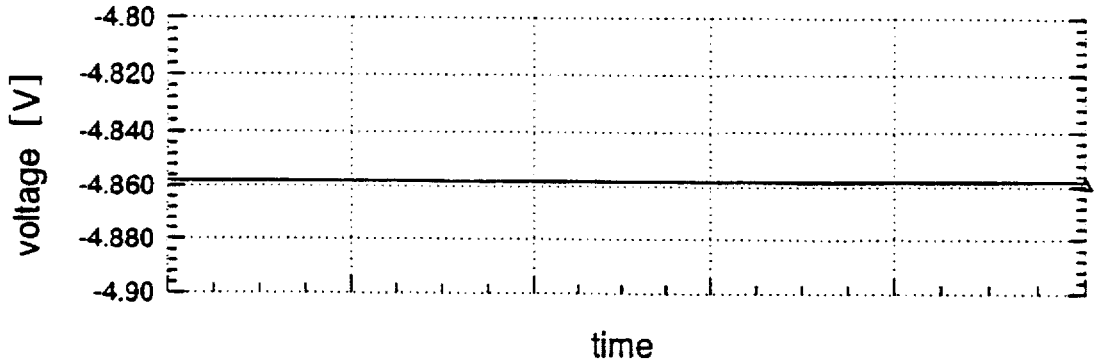
FIGS. 11(*a*) and 11(*b*) are diagrams illustrating node voltages and input and output currents, respectively, in the current driver circuit shown in FIG. 9, and FIG. 11(*c*) is a diagram illustrating an output current from the current driver circuit shown in FIG. 9, when a high frequency component is superposed on an input current of the current driver circuit.
Figure 11:
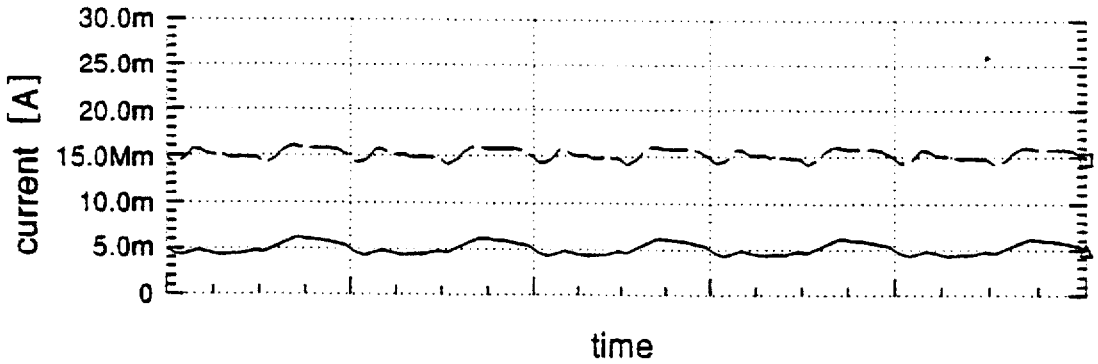
Figure 11:
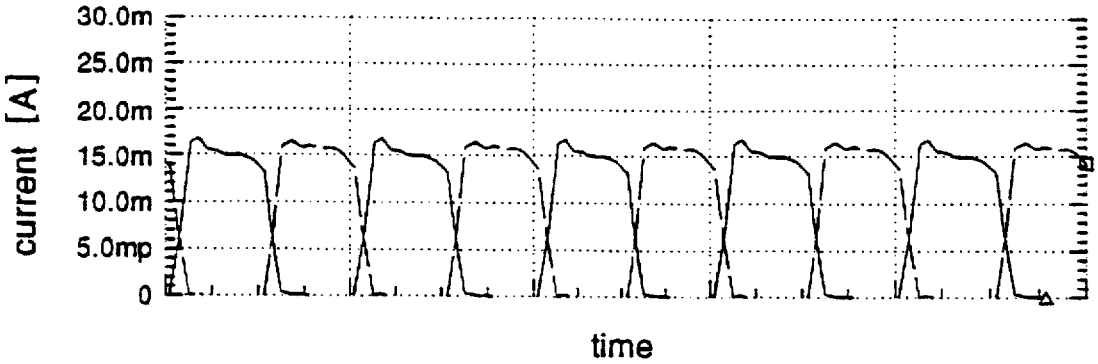

On the other hand, FIGS. 11(*a*), 11(*b*), and 11(*c*) are diagrams illustrating the node voltage, the input and output currents $I_1$ and $I_2$, and the output current from the driver circuit, respectively, when a high frequency component is superposed on the input current $I_1$ in the current mirror circuit of the current driver circuit according to this fifth embodiment. The input signal Sig is a sinusoidal wave at 10 GHz. The gate width of the FET A11 in the current mirror circuit is 200 μm, and the gate width of the FET A12 is 600 μm. The input current $I_1$ is 5 mA, and the high frequency component is ±1 mA. The bypass capacitor C1 is 40 pF. FIG. 11(*a*) shows the gate voltage of the FET A12. This gate voltage is constant regardless of the high frequency component in the input current $I_1$. FIG. 11(*b*) shows the input current $I_1$ and the output current $I_2$ of the current mirror circuit, wherein the solid line shows the input current $I_1$ (=5±1 mA) and the dashed line shows the output current $I_2$ from the current mirror circuit. FIG. 11(*c*) shows a waveform of the output current from the output terminals OUT and $\overline{OUT}$ of the driver circuit. In this fifth embodiment, the variation in the output current $I_2$ from the current mirror circuit is less than 1 mA, whereby the symmetry of the output current amplitude from the driver circuit is significantly improved.

As mentioned above, in the current mirror circuit according to the first embodiment, the output current $I_2$ depends on both the gate voltage and the drain voltage of the FET A12, but the variation in the gate voltage dominates the output current distortion because a relationship of $\Delta I_{ds}$=drain conductance $G_d \cdot \Delta V_{ds}$ stands between the variation in the drain-source voltage of the FET ($\Delta V_{ds}$) and the variation in the output current ($\Delta I_{ds}$) whereas a relationship of $\Delta I_{ds}$= transconductance $G_m \cdot \Delta V_{gs}$ stands between the variation in the gate-source voltage of the FET ($\Delta V_{gs}$) and the variation in the output current and, therefore, $G_m >> G_d$.

Therefore, the constant current source 30*b* having the bypass capacitor C1 can significantly reduce the distortion in the output current, and the signal processing circuit employing this constant current source 30*b* is hardly affected by the power supply noise.

As described above, in the signal processing circuit according to this fifth embodiment, since the bypass capacitor C1 is connected between the gate terminal of the FET A12, which is a constituent of the constant current source 30*b*, and the ground GND, variations in the gate voltage are suppressed, whereby distortion in output current of the constant current source 30*b* is reduced. Therefore, the signal processing circuit including this constant current source 30*b* is hardly affected by power supply noise, whereby the modulation current is controlled with high accuracy.

Embodiment 6

Figure 12:
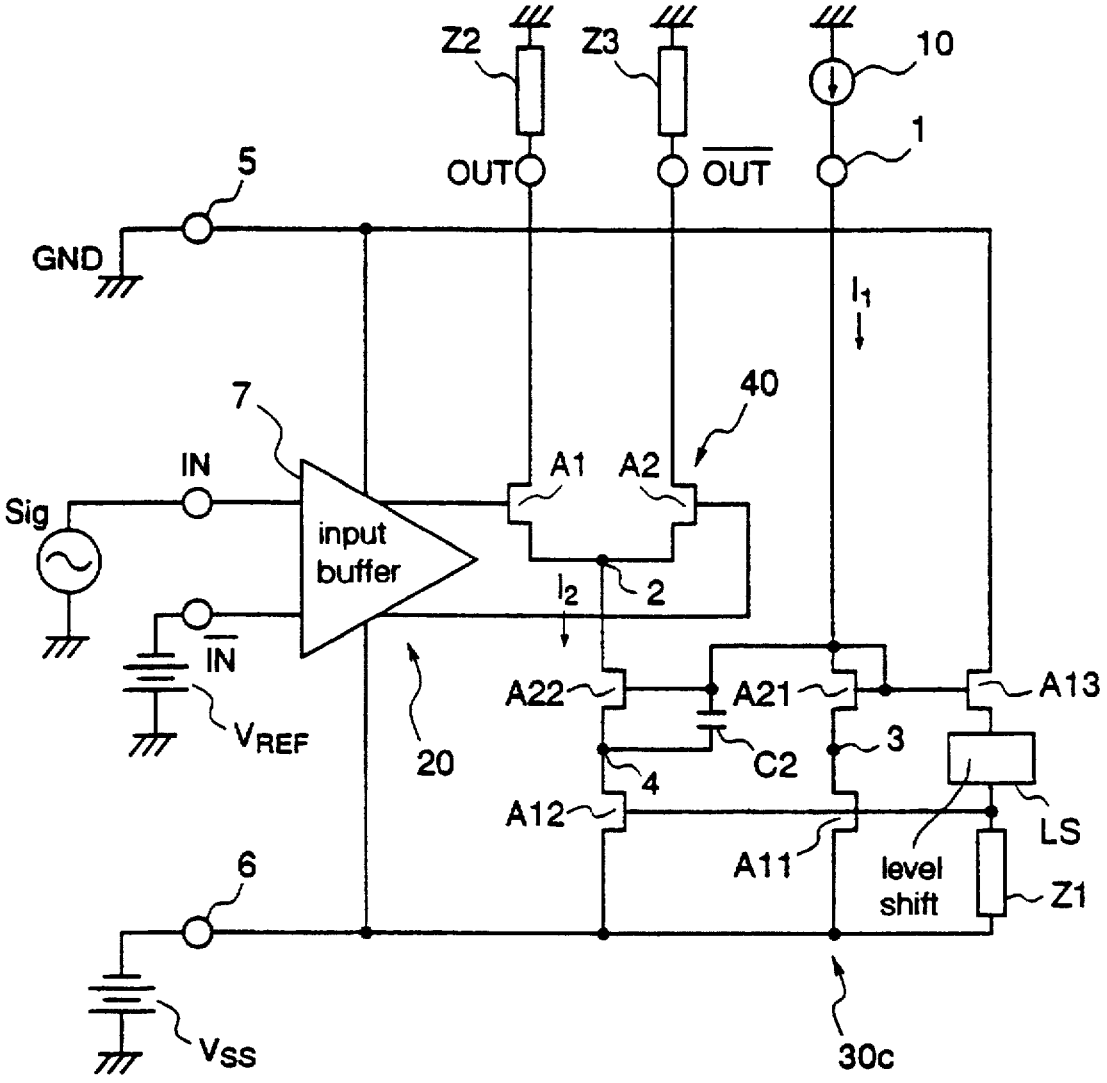
FIG. 12 is a diagram illustrating a current driver circuit employing the current mirror circuit shown in FIG. 4 as a constant current source, according to a sixth embodiment of the present invention.

FIG. 12 is a diagram illustrating an open drain type current driver circuit employing a current mirror circuit according to the third embodiment of the invention as a constant current source for a differential circuit, according to a sixth embodiment of the present invention.

In the figure, reference numeral 30*c* designates a constant current source comprising a current mirror circuit similar to the current mirror circuit shown in FIG. 4. In the current mirror circuit, the voltage at the output terminal 2 is equal to a difference between the output level at the output terminal OUT ($\overline{OUT}$) of the input buffer 7 and the gate-source voltage of the FET A1 (FET A2).

In the constant current source 30*c*, a bypass capacitor C2 is connected between the gate terminal and the source terminal of the FET A22, whereby distortion in output current characteristics is reduced.

In the fifth embodiment of the invention, since the bypass capacitor C1 is connected to the FET A12 in the constant current source 30*b*, the drain-source current of the FET A12 is kept constant, whereby the drain-source current of the FET A22 is kept constant. In other words, the gate-source voltage of the FET A22 is kept constant. Therefore, when the bypass capacitor C2 is connected between the gate and the source of the FET A22, the gate-source voltage of the FET A22 is kept constant for high frequencies, and the drain current of the FET A22 is made constant, whereby the gate-source potential of the FET A12 is fixed from the point of view of an equivalent circuit.

Figure 13:
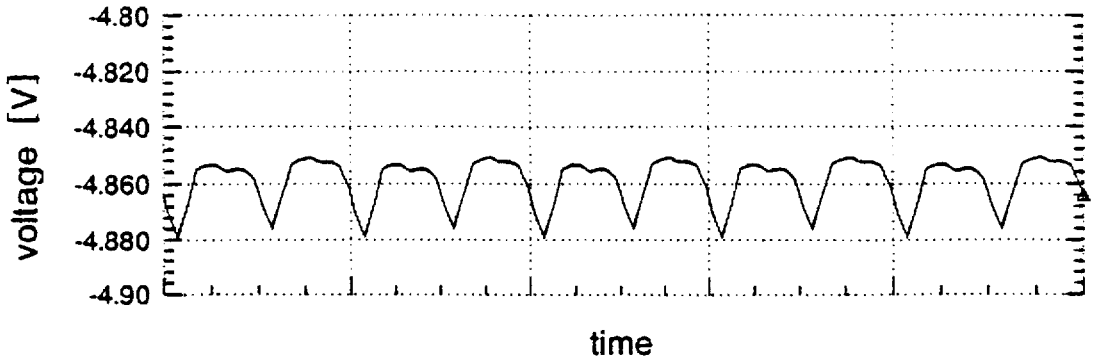
FIGS. 13(*a*) and 13(*b*) are diagrams illustrating node voltages and input and output currents, respectively, in the current driver circuit shown in FIG. 12, and FIG. 13(*c*) is a diagram illustrating an output current from the current driver circuit shown in FIG. 12.
Figure 13:
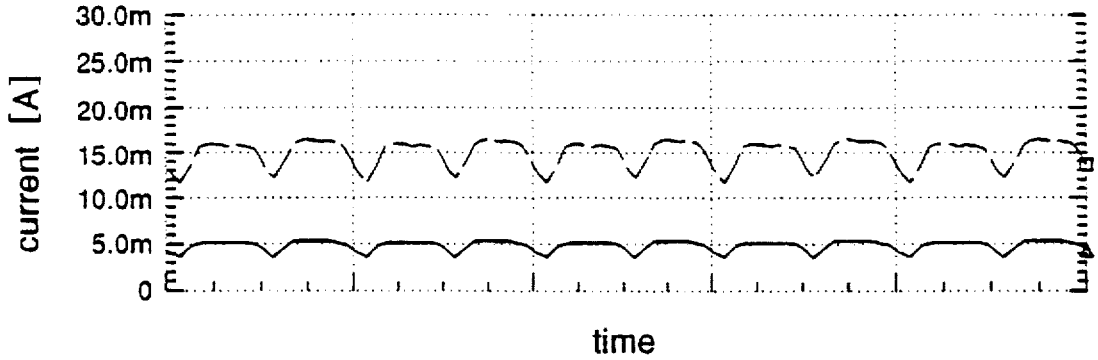
Figure 13:
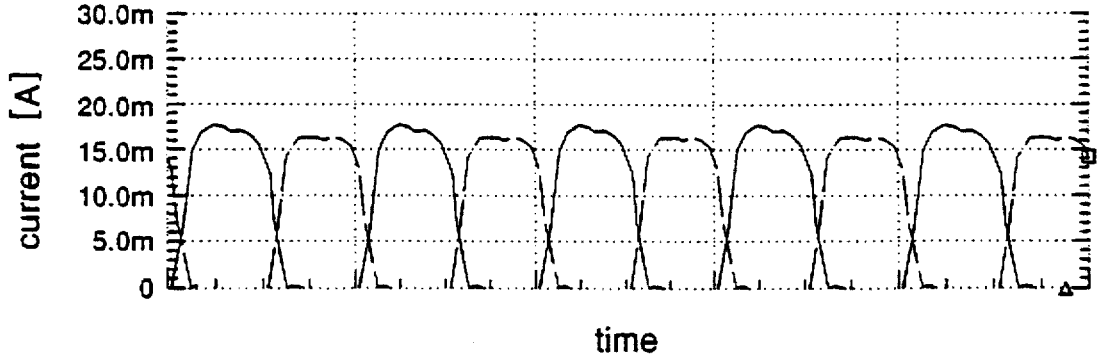

FIGS. 13(*a*), 13(*b*), and 13(*c*) are diagrams illustrating a node voltage, input and output currents $I_1$ and $I_2$, and an output current from the driver circuit, respectively, when a high frequency component is superposed on the input current $I_1$ in the current mirror circuit in the current driver circuit according to this sixth embodiment. The input signal Sig is a sinusoidal wave at 10 GHz. The gate width of the FET A11 in the current mirror circuit is 200 μm, and the gate width of the FET A12 is 600 μm. The input current $I_1$ is 5 mA, and the high frequency component is ±1 mA. The bypass capacitor C2 is 40 pF. FIG. 13(*a*) shows the gate voltage of the FET A12. This gate voltage is almost constant regardless of the high frequency component in the input current $I_1$. FIG. 13(*b*) shows the input current $I_1$ and the output current $I_2$ of the current mirror circuit, wherein the solid line shows the input current $I_1$ (=5±1 mA) and the dashed line shows the output current $I_2$ from the current mirror circuit. FIG. 13(*c*) shows waveforms of the output current from the output terminals OUT and $\overline{OUT}$ of the driver circuit. In this sixth embodiment, the variation in the output current $I_2$ from the current mirror circuit is reduced, whereby the symmetry of the output current amplitude in the driver circuit is significantly improved.

In this way, the bypass capacitor C2 can reduce distortion in output current when the input current is subjected to modulation.

Therefore, the constant current source 30*c* including the bypass capacitor C2 can significantly reduce distortion in output current, and the signal processing circuit including this constant current source 30*c* is hardly affected by power supply noise.

As described above, according to the sixth embodiment of the invention, since the bypass capacitor C2 is connected between the gate terminal and the source terminal of the FET A12 which is an constituent of the constant current source 30*c*, variations in the gate voltage are suppressed, whereby distortion in output current characteristics of the constant current source 30*c* is reduced. Therefore, the signal processing circuit including the constant current source 30*c* is hardly affected by power supply noise, whereby the modulation current is controlled with high accuracy.

What is claimed is:

1. A current mirror circuit comprising:

a positive power supply terminal;

a negative power supply terminal;

a current input terminal;

a current source connected between the positive power supply terminal and the current input terminal;

a first field effect transistor and a second field effect transistor, each of the first and second field effect transistors having a gate terminal, a drain terminal, and a source terminal, the gate terminal of the first field effect transistor being connected to the gate terminal of the second field effect transistor, the source terminals of the first field effect transistor and the second field effect transistor being connected to each other and to the negative power supply terminal;

a resistor having a first end connected to the source terminal of the first field effect transistor and a second end connected to the gate terminal of the first field effect transistor;

a level shift circuit having a low potential end connected to the gate terminal of the first field effect transistor, and a high potential end;

a third field effect transistor having a source terminal connected to the drain terminal of the first field effect transistor, and a drain terminal and a gate terminal connected to each other and to the current input terminal;

a fourth field effect transistor having a source terminal connected to the drain terminal of the second field effect transistor, a gate terminal connected to the gate terminal of the third field effect transistor, and a drain terminal serving as a current output terminal; and a fifth field effect transistor having a source terminal connected to the high potential end of the level shift circuit, a gate terminal connected to the gate terminal of the third field effect transistor, and a drain terminal connected to the positive power supply terminal.

2. The current mirror circuit of claim 1 further including a bypass capacitor connected between the gate terminal of the second field effect transistor and ground.

3. The current mirror circuit of claim 1 further including a bypass capacitor connected between the gate terminal and the source terminal of the fourth field effect transistor.

4. A signal processing circuit comprising:

an amplifying circuit including a differential amplifier for differentially amplifying an input signal; and a constant current source for supplying a constant current to the amplifying circuit, the constant current source comprising a current mirror circuit including:

a positive power supply terminal, a negative sower supply terminal, a current input terminal, a current source connected between the positive power supply terminal and the current input terminal, a first field effect transistor and a second field effect transistor, each of the first and second field effect transistors having a gate terminal, a drain terminal, and a source terminal, the gate terminal of the first field effect transistor being connected to the gate terminal of the second field effect transistor, the source terminals of the first field effect transistor and the second field effect transistor being connected to each other and to the negative power supply terminal, a resistor having a first end connected to the source terminal of the first field effect transistor and a second end connected to the gate terminal of the first field effect transistor;

a level shift circuit having a low potential end connected to the gate terminal of the first field effect transistor, and a high potential end, a third field effect transistor having a source terminal connected to the drain terminal of the first field effect transistor, and a drain terminal and a gate terminal connected to each other and to the current input terminal, and a fourth field effect transistor having a source terminal connected to the drain terminal of the second field effect transistor, a gate terminal connected to the gate terminal of the third field effect transistor, and a drain terminal serving as a current output terminal, and a fifth field effect transistor having a source terminal connected to the high potential end of the level shift circuit, a gate terminal connected to the gate terminal of the third field effect transistor, and a drain terminal connected to the positive power supply terminal.

5. The signal processing circuit of claim 4 wherein the current mirror circuit includes a bypass capacitor connected between the gate terminal of the second field effect transistor and ground.

6. The signal processing circuit of claim 4 wherein the current mirror circuit includes a bypass capacitor connected between the gate terminal and the source terminal of the fourth field effect transistor.

7. The signal processing circuit of claim 4 wherein the amplifying circuit comprises:

an input buffer for amplifying a pair of input signals and outputting a pair of output signals; and an open drain circuit including a pair of differential field effect transistors receiving the output signals from the input buffer, the differential field effect transistors having source terminals connected to each other, wherein the constant current source supplies a constant current to the source terminals of the differential field effect transistors.

* * * * *

UNITED STATES PATENT AND TRADEMARK OFFICE

CERTIFICATE OF CORRECTION

PATENT NO. : 5,781,061

DATED : July 14, 1998

INVENTOR(S) : Miyashita et al.

It is certified that error appears in the above-identified patent and that said Letters Patent is hereby corrected as shown below:

Column 16, Line 5, change "sower" to --power--.

Signed and Sealed this

Twenty-fourth Day of November, 1998

*Attest:*

*Attesting Officer*

Bruce Lehman

BRUCE LEHMAN

*Commissioner of Patents and Trademarks*